US011316311B1

(12) United States Patent
Chan et al.

(10) Patent No.: US 11,316,311 B1
(45) Date of Patent: Apr. 26, 2022

(54) MODULAR ELECTRO-MAGNETIC CONNECTIONS AND APPLICATIONS THEREOF

(71) Applicant: Ecco Design, Inc., New York, NY (US)

(72) Inventors: Eric Ping Pang Chan, New York, NY (US); Michael Morath, Baden-Wuerttemberg (DE)

( * ) Notice: Subject to any disclaimer, the term of this patent is extended or adjusted under 35 U.S.C. 154(b) by 0 days.

(21) Appl. No.: 17/146,947

(22) Filed: Jan. 12, 2021

(51) Int. Cl.

| | |
|---|---|
| ***H01R 13/62*** | (2006.01) |
| ***H01R 25/14*** | (2006.01) |
| ***H01R 25/16*** | (2006.01) |
| ***H01R 13/20*** | (2006.01) |
| ***H01R 41/00*** | (2006.01) |
| *H01R 13/50* | (2006.01) |

(52) U.S. Cl.
CPC ..... *H01R 25/142* (2013.01); *H01R 13/20* (2013.01); *H01R 13/6205* (2013.01); *H01R 25/161* (2013.01); *H01R 41/00* (2013.01); *H01R 13/50* (2013.01)

(58) Field of Classification Search
CPC .... H01R 13/20; H01R 13/50; H01R 13/6205; H01R 25/142; H01R 25/161; H01R 11/30; F21V 21/096; F21V 17/105
See application file for complete search history.

(56) References Cited

U.S. PATENT DOCUMENTS

| | | | | |
|---|---|---|---|---|
| 7,025,597 | B1 * | 4/2006 | Chang | H01R 11/287 439/39 |
| 7,641,477 | B2 | 1/2010 | DiFonzo et al. | |
| 8,651,711 | B2 * | 2/2014 | Rudisill | F21V 29/507 362/398 |
| 8,734,165 | B2 * | 5/2014 | Neel | H01R 11/30 439/39 |
| 9,614,378 | B2 | 4/2017 | Golko et al. | |
| 10,897,114 | B2 * | 1/2021 | Bombara | H01R 33/88 |
| 11,070,035 | B2 * | 7/2021 | Chan | H01F 7/0252 |
| 2012/0282786 | A1 | 11/2012 | Neel | |
| 2015/0171564 | A1 | 6/2015 | Hsu et al. | |
| 2016/0268728 | A1 | 9/2016 | Zantout et al. | |
| 2019/0103702 | A1 | 4/2019 | Chan et al. | |

FOREIGN PATENT DOCUMENTS

| | | | |
|---|---|---|---|
| JP | 2012-234811 | A | 11/2012 |
| WO | 2017152183 | A1 | 9/2017 |

OTHER PUBLICATIONS

International Search Report and Written Opinion for Application No. PCT/US2017/020977 dated Jun. 14, 2017.
International Search Report and Written Opinion for Application No. PCT/US2020/056803 dated Feb. 10, 2021.

* cited by examiner

*Primary Examiner* — Vanessa Girardi

(57) ABSTRACT

Functional modules of a modular system include a magnet and at least two conductors, at least one of which is movable into the functional module and at least one of which is formed of ferrous material. The movable conductor is biased against movement into the functional module and is positioned such that it contacts a power delivery conductor before the other conductor of the functional module contacts another power delivery conductor. The magnet provides attraction between the functional module and a power delivery module that assists in overcoming the bias against movement of the movable conductor into the functional module.

20 Claims, 40 Drawing Sheets

VV

MODULAR ELECTRO-MAGNETIC CONNECTIONS AND APPLICATIONS THEREOF

CROSS REFERENCE TO RELATED APPLICATIONS

This application is related to U.S. patent application Ser. No. 16/659,613, filed Oct. 22, 2019, and PCT International Application No. PCT/US2017/020977, filed Mar. 6, 2017, which claims the benefit of U.S. Provisional Application No. 62/303,927, filed Mar. 4, 2016, U.S. Provisional Application No. 62/303,943, filed Mar. 4, 2016, and U.S. Provisional Application No. 62/397,629, filed Sep. 21, 2016, each of which is hereby incorporated by reference in its entirety.

This application for letters patent disclosure document describes inventive aspects that include various novel innovations (hereinafter "disclosure") and contains material that is subject to copyright, mask work, and/or other intellectual property protection. The respective owners of such intellectual property have no objection to the facsimile reproduction of the disclosure by anyone as it appears in published Patent Office file/records, but otherwise reserve all rights.

BACKGROUND

Current electrical power supply systems are often difficult to install and are non-extendible. For example, installation of a typical power outlet only provides a limited number of ports and often requires construction to access the interior of the wall to access the electrical wiring. Further, such electrical power outlets are not extendible without more construction or without using bulky and unsightly power extension cords.

Modular electrical systems, such as track lighting systems, allow electricity to be provided along an interior track. However, these electrical modular systems often require expensive installation and are difficult to modify on once installed. Further, track lighting systems only allow one degree of freedom of placement and movement (i.e., along the track) and the system is not designed to be used with other functional modules, such as extenders or wireless devices. It is an aim of the present invention to address the drawbacks of typical electrical and modular power supply systems.

In addition, modular electrical systems like track lighting systems typically operate at line voltages, making them unsafe for use in close proximity to humans or animals, for example on a desktop. Also, many modular electrical systems are bulky and unsightly, often due to their operation at line voltage and the corresponding need for increased conductivity and electrical resistance of the structures used to carry and isolate power, respectively. An additional source of bulk and frustration is that many current modular power systems include features that force a connection between components to occur in only one orientation so as to maintain a strict electric polarity mapping among conductors and modules.

It is the objective of the inventions described herein to provide effective solution to these and other problems in the existing options for providing modular electric connections.

SUMMARY

The subject of this specification relates to a modular electrical power supply system that allows power delivery and functional modules to be easily installed and rearranged.

In particular, the present inventions involve magnetic and ferrous components in the connections to facilitate physical and electrical connections between modules.

In one aspect, a functional module comprises a magnet, a conductor formed around the magnet, a peg situated in and movable through an aperture of the magnet, a biasing member configured to resist a movement of the peg through the magnet aperture into the functional module, and circuitry electrically connected to the conductor and the peg, wherein at least one of the conductor and the peg is formed of a ferrous material and is configured to channel and focus magnetic flux from the magnet, thereby increasing a strength of magnetic flux at an exterior surface of the at least one of the conductor and the peg to a level greater than would be present there with the magnet alone, while at the same time the conductor and the peg are configured to electrically conduct at least one of power and data to the circuitry.

In some implementations, the magnet is a toroidal magnet and the conductor circumscribes and contacts an exterior surface of the magnet.

In one example, the functional module further comprises an electrically insulative material between a surface of the magnet aperture and the peg.

In another example, the functional module further comprises an electrically insulative material between an exterior surface of the magnet and the conductor.

In another example, the conductor protrudes from an exterior surface of a housing of the functional module.

In another example, the biasing member is configured to provide at least a portion of an electrically conductive path between the peg and the circuitry.

In another aspect, a modular system comprises a functional module comprising a magnet, a conductor formed around the magnet, a peg situated in and movable through an aperture of the magnet, a biasing member configured to resist a movement of the peg through the magnet aperture into the functional module, and circuitry electrically connected to the conductor and the peg, wherein at least one of the conductor and the peg is formed of a ferrous material and is configured to channel and focus magnetic flux from the magnet, thereby increasing a strength of magnetic flux at an exterior surface of the at least one of the conductor and the peg to a level greater than would be present there with the magnet alone, while at the same time the conductor and the peg are configured to electrically conduct at least one of power and data to the circuitry. In this aspect, the modular system also comprises a power delivery module comprising first and second spaced apart power delivery conductors, at least one of which is formed of ferrous material, and a first power supply electrically connected to the first and second conductors, wherein the peg of the functional module is configured to extend from an external surface of the conductor of the functional module by a distance that is greater than the space between the first and second power delivery conductors such that the peg is configured to contact the first power delivery conductor before the conductor of the functional module is able to contact the second power delivery conductor and contact between the conductor of the functional module and the second power delivery conductor occurs after the peg is moved into the functional module against the resistance of the biasing member.

In some implementations, the magnet of the functional module provides an attraction between the functional module and the power delivery module that assists movement of the peg into the functional module against the resistance of the biasing member.

In one example, the power delivery module is configured to provide discrete receiving sites for the peg of the functional module, the first power delivery conductor being exposed for contact by the peg only at said discrete receiving sites.

In another example, the power delivery module further comprises an insulative material on an exterior of the second power delivery conductor, said insulating material having discrete openings therein around said discrete receiving sites exposing the exterior of the second power delivery conductor for contact by the conductor of the functional module at said discrete receiving sites.

In another example, the power delivery module is configured to provide for connection between the peg and conductor of the functional module and the first and second power delivery conductor, respectively, at non-discrete locations along a length of the power delivery module.

In another example, the power delivery module further comprises third and fourth spaced apart power delivery conductors, at least one of which is formed of ferrous material, the third and fourth power delivery conductors are spaced apart by a smaller distance than the distance that the peg of the functional module extends from the external surface of the conductor of the functional module such that the peg is configured to contact the third power delivery conductor before the conductor of the functional module is able to contact the fourth power delivery conductor and contact between the conductor of the functional module and the fourth power delivery conductor occurs after the peg is moved into the functional module against the resistance of the biasing member.

In another example, the third and fourth power delivery conductors are electrically connected to the first and second power delivery conductors, respectively.

In another example, the third and fourth power delivery conductors are electrically connected to a second power supply that is different than the first power supply.

In another example, the power delivery module is configured to provide for connection between the peg and conductor of the functional module and the third and fourth power delivery conductor, respectively, at non-discrete locations along a length of the power delivery module.

In another example, the power delivery module further comprises an additional power delivery conductor electrically connected to the second power delivery conductor and configured such that the conductor of the functional module contacts the additional power delivery conductor as the conductor of the functional module also contacts the second power delivery conductor.

In another example, the power delivery module includes an undercut surface configured to physically retain the peg of the functional module in contact with the first power delivery conductor.

In another example, the undercut surface of the power delivery module is configured to physically retain the peg of the function module in contact with the first power delivery conductor only after the functional module is shifted in a direction orthogonal to an axis of the peg relative to the power delivery module after the peg contacts the first power delivery conductor.

In another example, one of the first and second power delivery conductors is formed of non-ferrous electrically conductive material.

In another example, the power delivery module further comprises an insulative material between the first and second power delivery conductor configured such that a movement of the functional module in a direction orthogonal to an axis of the peg relative to the power delivery module cannot result in electrical contact between the second power delivery conductor and the peg.

DETAILED DESCRIPTION

Embodiments of modular electro-magnetic connections, applications thereof and methods for their installation are described herein. While aspects of the described connections can be implemented in any number of different configurations, the embodiments are described in the context of the following exemplary configurations. The descriptions and details of well-known components and structures are omitted for simplicity of the description.

The description and figures merely illustrate exemplary embodiments of the inventive connections and applications thereof. It will thus be appreciated that those skilled in the art will be able to devise various arrangements that, although not explicitly described or shown herein, embody the principles of the present subject matter. Furthermore, all examples recited herein are intended to be for illustrative purposes only to aid the reader in understanding the principles of the present subject matter and the concepts contributed by the inventors to furthering the art, and are to be construed as being without limitation to such specifically recited examples and conditions. Moreover, all statements herein reciting principles, aspects, and embodiments of the present subject matter, as well as specific examples thereof, are intended to encompass equivalents thereof. Various embodiments described herein provide an overview of the present inventions' key features. However, the designs' features are not limited to the examples and figures provided herein for illustration purposes.

In general, the present disclosure provides various arrangements of metallic and magnetic components the serve to both provide for conduction of electrical power between modules as well as a physical attraction between modules to assist with alignment, holding the modules together, etc.

Figure 1:
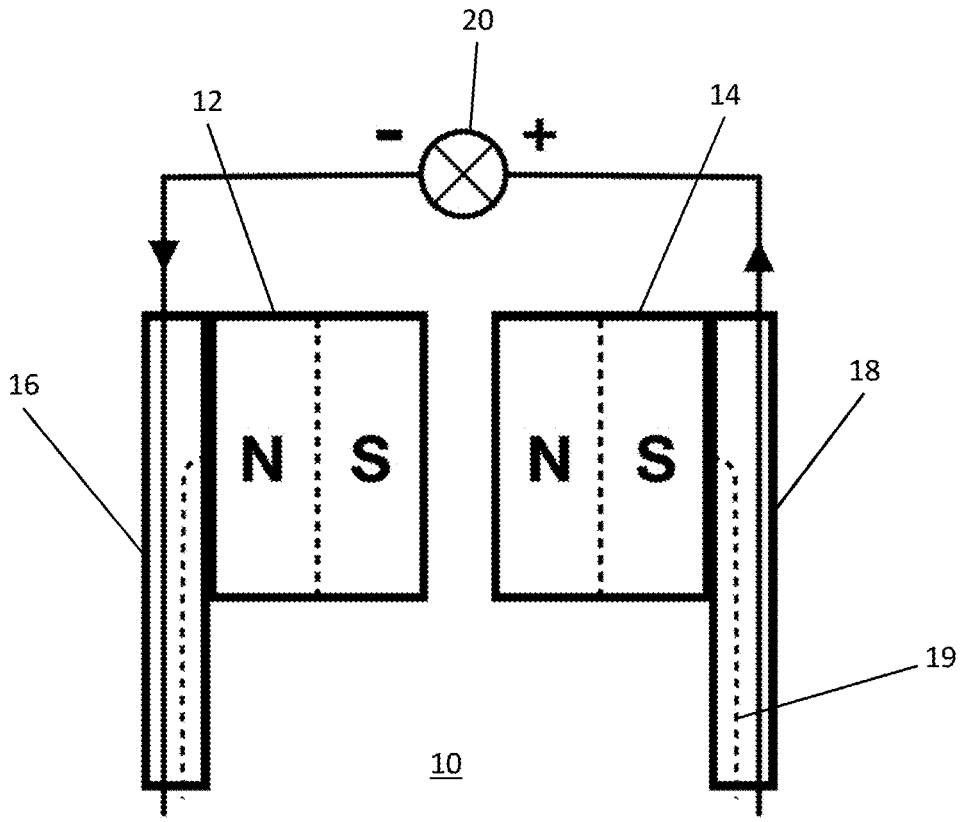
FIG. 1 shows a cross section view of a functional module according to an exemplary embodiment.

In an exemplary approach, shown generally in FIG. 1, a functional module 10 includes circuitry 20 that is electrically connected to one or more electromagnetic conductor assemblies each comprising a magnet (each with north and south magnetic poles, N and S, respectively) in contact with a ferrous conductor. The ferrous conductors serve to channel and focus magnetic flux from the magnets, increasing the strength of the magnetic flux 19 at the exposed ends of the ferrous conductors to a level greater than is present with the magnets alone. The focused magnetic flux 19 increases attachment strength to ferrous conductors of a power delivery module. In another function, performed at the same time as the magnetic flux 19 is being focused, the ferrous conductors also conduct electric power or signals to the circuitry from ferrous conductors of power delivery modules. In the example shown in FIG. 1, the functional module 10 includes two electromagnetic conductor assemblies, the first comprising magnet 12 and ferrous conductor 16 and the second comprising magnet 14 and ferrous conductor 18. The electromagnetic conductor assemblies are electrically isolated from one another by, for example, an air gap, a non-electrically conductive material, etc.

Figure 2:
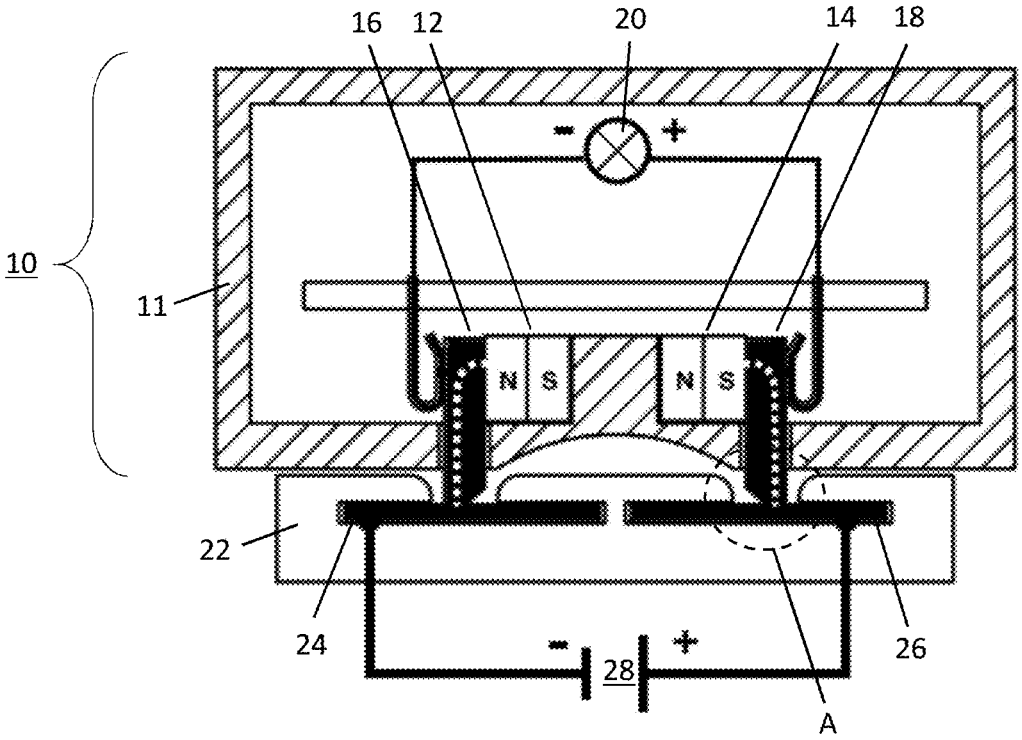
FIG. 2 shows a cross section view of a functional module and power delivery module according to an exemplary embodiment.

FIG. 2 shows an example of a functional module 10 that includes an optional housing 11. As shown in FIG. 2, the housing 11 may be not electrically conductive and a portion thereof may be configured to separate the magnets 12 and 14. Circuitry 20 receives power conducted through ferrous conductors 16 and 18 from a power delivery module 22. Power delivery module 22 includes ferrous conductors 24 and 26 which are configured to conduct power from power supply 28 and also be magnetically attracted to the ferrous conductors of the functional module. Any of the ferrous conductors of the functional module 10 or of the power delivery module 22 may be coated with an electrically conducting material to improve, for example, electrical conductivity, wear resistance, environmental stability (e.g., resistance to rust and/or oxidation), appearance, etc. For example, one or more of the ferrous conducting elements may be electroplated.

Figure 44:
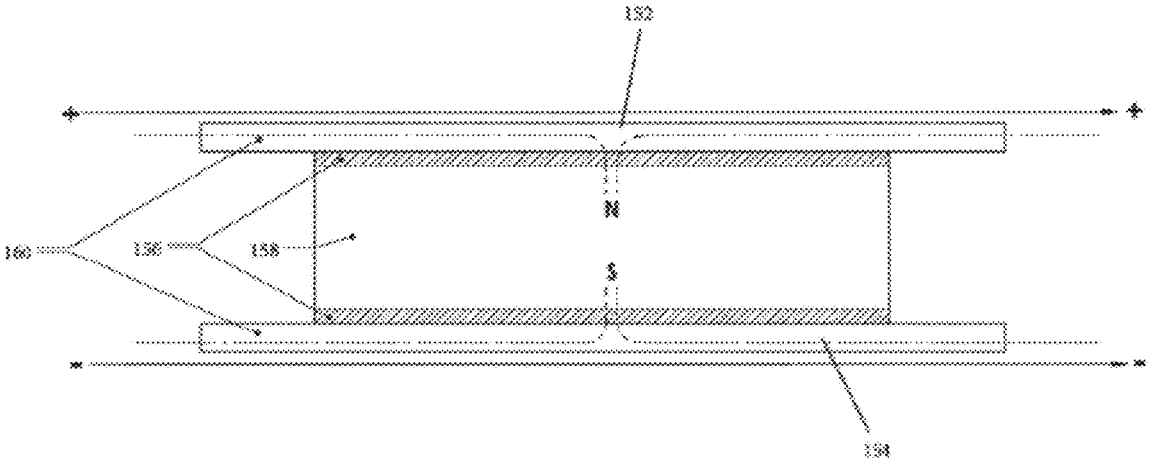
FIG. 44 shows a cross section view of a modular electromagnetic connection component.

In another approach, shown generally in FIG. 44, a single magnet 158 with north and south magnetic poles (N and S, respectively) is electrically isolated from ferrous conductors 152 and 154 by insulators 156. A power supply 160 provides positive and negative polarity power to the conducting elements 152 and 154, respectively. Accordingly, this arrangement provides power to a mating module having ferrous conductors arranged to contact conductors 152 and 154, while at the same time being magnetically attracted thereto.

In either approach, power is conducted through ferrous conductors rather than through one or more magnets. The ferrous conductors are generally better electrical conductors, with less electrical resistance than the one or more magnets. In addition, if electrical power were to pass through the one or more magnets, the magnet(s) may be subjected to mechanical and/or thermal stress, potentially raising operating temperatures and/or degrading magnetic properties of the magnet(s).

FIG. 2 depicts the provided power as being polarized (for example, DC power), the present inventions are also compatible with non-polarized power applications (for example, AC power) and data transmission applications in which no appreciable power is conducted. In a data transmission application, circuitry 20 might be a data transceiver configured to transmit and receive data over conductors 16 and 18, through conductors 24 and 26, respectively, and ultimately to another data transceiver in place of power supply 28. Of course, the present inventions are not limited to applications with two conductors—any number of conductors may be employed according to the needs of the application.

Figure 3:
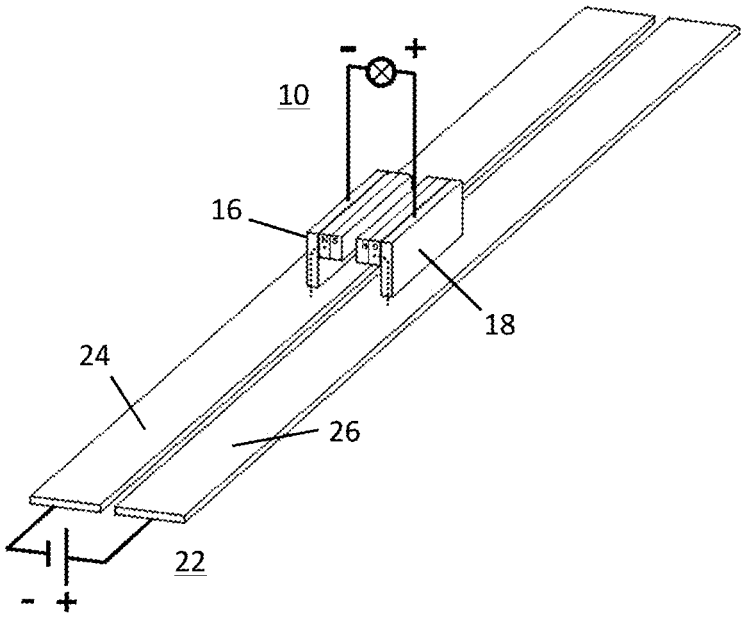
FIG. 3 shows a partial perspective view of a functional module and power delivery module according to an exemplary embodiment.

As shown in FIG. 3, conductors 24 and 26 may be formed in an elongate fashion, allowing functional module 10 to connect thereto and receive power at any point along their length. In addition, because the power delivery module and functional module are not rigidly connected, but rather held together through magnetic attraction, functional module may be slid along the conductors 24 and 26 of the power delivery module in a dynamic fashion without interruption of the electrical connection between the modules.

Figure 4:
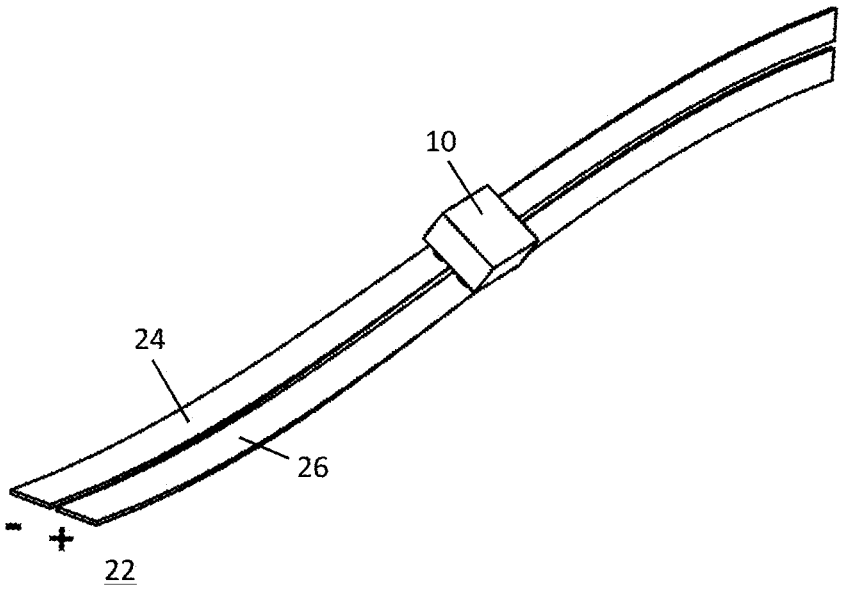
FIG. 4 shows an example of a power delivery module that is curved in three dimensions according to an exemplary embodiment.
Figure 5:
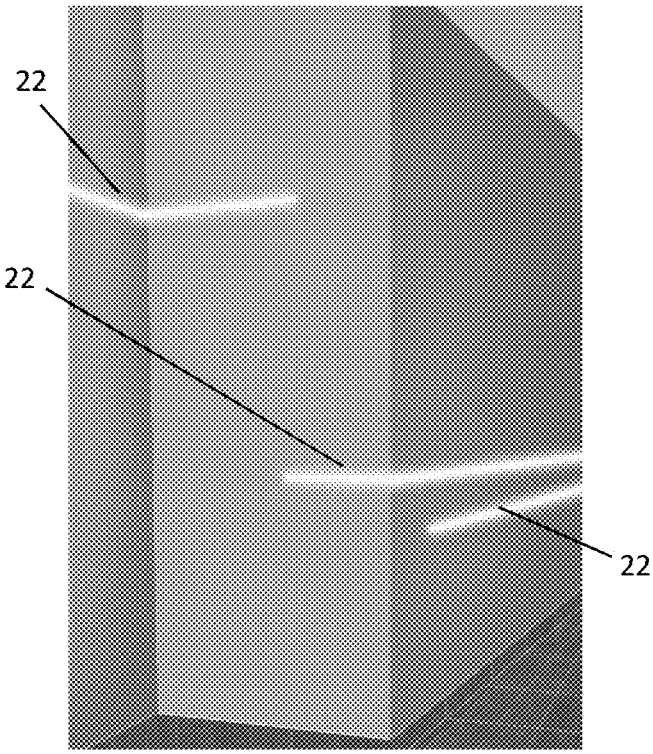
FIG. 5 shows an example of a power delivery module that is angled or bent to accommodate inside and outside corners of a wall according to an exemplary embodiment.
Figure 6:
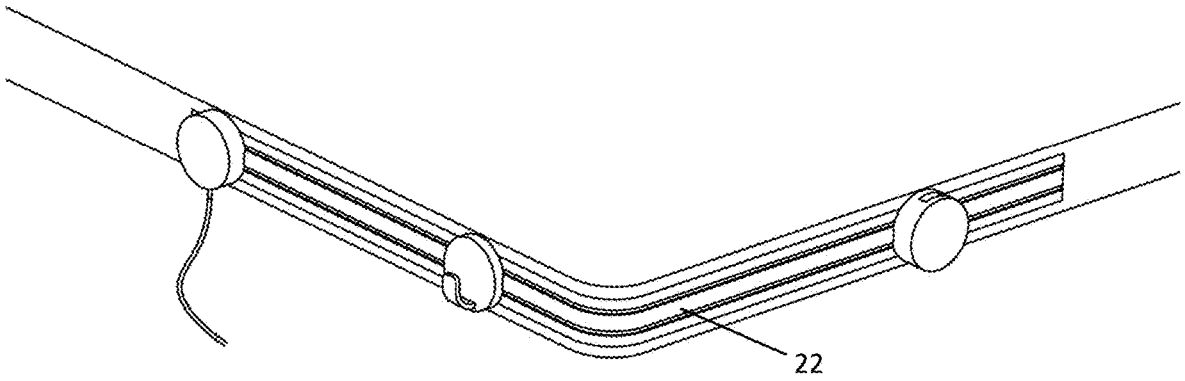
FIG. 6 shows an example of a power delivery module that includes a bend according to an exemplary embodiment.
Figure 7:
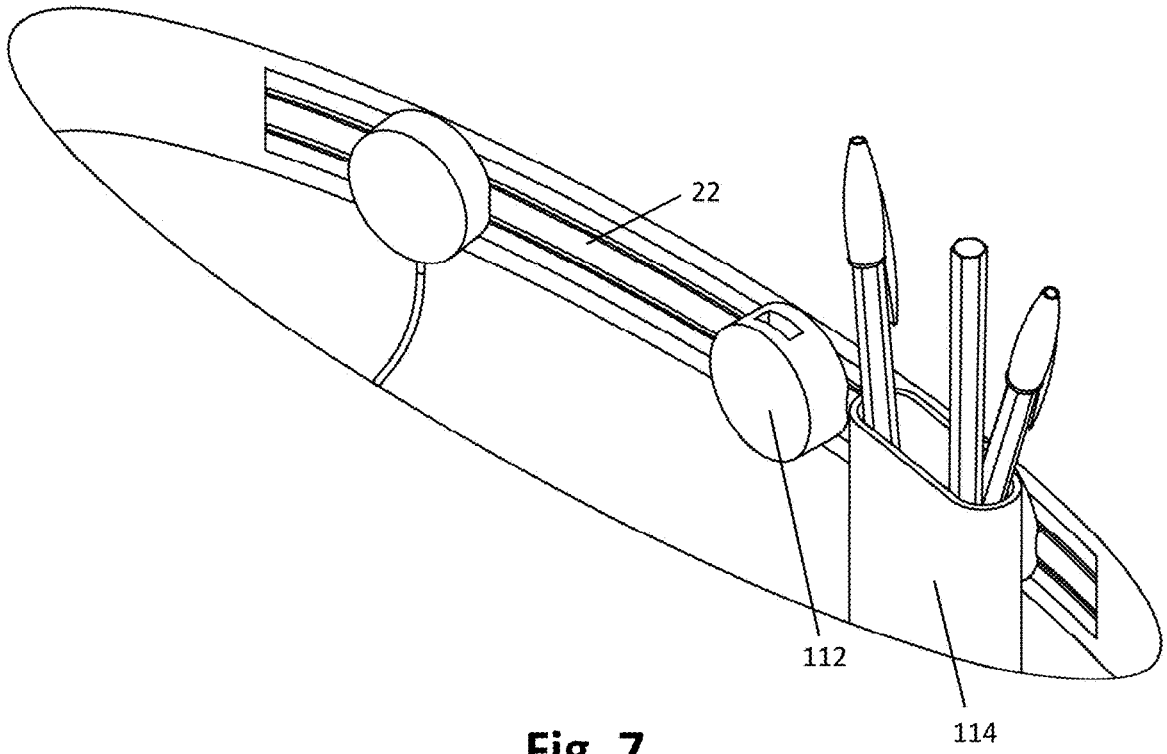
FIG. 7 shows an example of a power delivery module that is curved and is formed along the sidewall of an interior hole in a countertop or desk surface according to an exemplary embodiment.

As shown in FIG. 4, the power delivery module 22 and the conductors 24 and 26 therein need not be straight or linear; they may be bent or shaped in any three dimensional direction(s). For example, as shown in FIG. 4, the conductors 24 and 26 (and the power delivery module 22 comprising them) may be helically or corkscrew shaped. They may also be angled or bent to follow the contours of walls and corners thereof, as shown in FIG. 5, depicting an embodiment with a light source embedded in the power delivery modules 22. FIG. 6 shows another embodiment in which a power delivery module 22 includes a bend. FIG. 7 shows yet another embodiment in which a power delivery module 22 is curved and is formed along the sidewall of an interior hole in a countertop or desk surface.

Figure 41A:
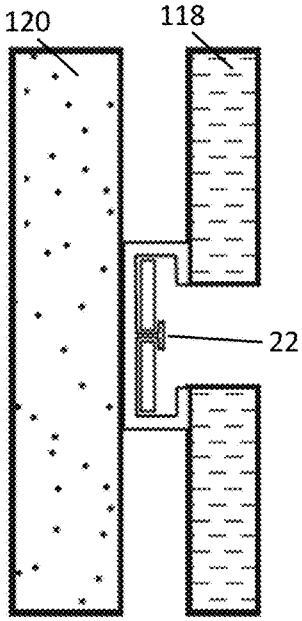
FIGS. 41*a*, 41*b* and 41*c* are cross sectional views of recessed, flush and surface mounting options of power delivery modules according to exemplary embodiments.
Figure 41B:
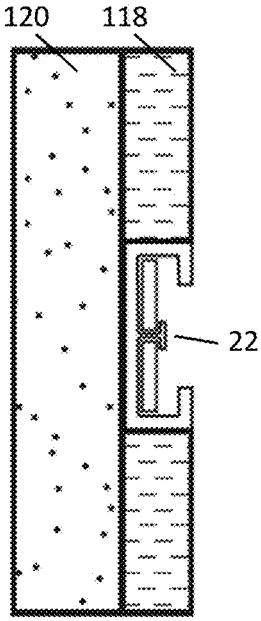
Figure 41C:
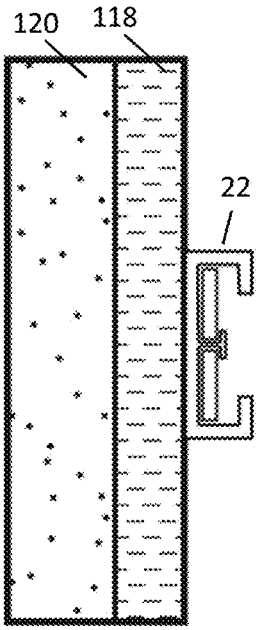

In settings where a power delivery module 22 is configured to be attached to a solid surface such as a wall or ceiling of a building, the module may be attached or integrated in one of several ways. For example, as shown in FIG. 41*a*, a power delivery module 22 may be recessed beneath a panel 118 and mounted on a substrate 120. In another example, as shown in FIG. 41*b*, a power delivery module 22 may be mounted on a substrate 120 such that it is flush with the user facing side of a panel 118. In another example, as shown in FIG. 41*c*, a power delivery module 22 may be surface mounted on a side of a panel 118.

Figure 8:
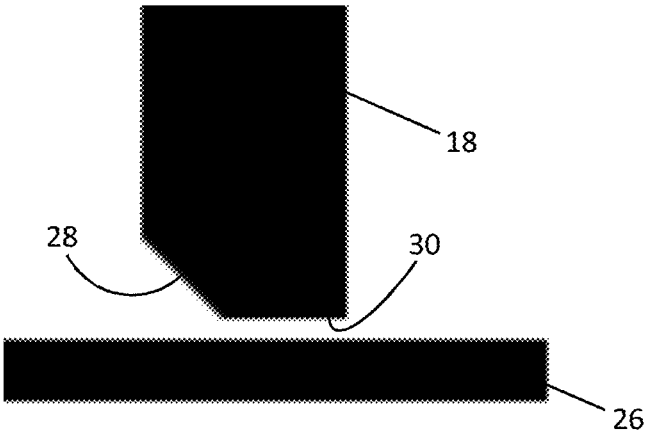
FIG. 8 is a zoomed in view of conductors 18 and 26 in area A in FIG. 2.

In one embodiment, functional module conductors 16 and 18 include a chamfer 28 along an inner edge thereof, as shown in FIG. 8, which is a zoomed in view of conductors 18 and 26 in area A of FIG. 2. In FIG. 8, the conductors are shown as separated slightly for the purpose of depicting the components' geometries, but in operation, the conductors would be touching, thus conducting electricity therethrough. Conductors 16 and 18 also include flat, substantially coplanar surfaces 30 which, in the configuration shown in FIGS. 2 and 8, contact conductors 24 and 26, respectively, which are also substantially coplanar in cross section. The chamfer 28, although depicted in FIG. 6 as a flat chamfer, with a linear cross section, may take any one of several forms including, for example, a concave or convex arc or two or more linear chamfers forming a concave or convex cross section. For example, a chamfer may be formed with a convex arc cross section sized to accommodate the cylindrical outer surface of conductors of a rod-shaped power delivery module.

Figure 9:
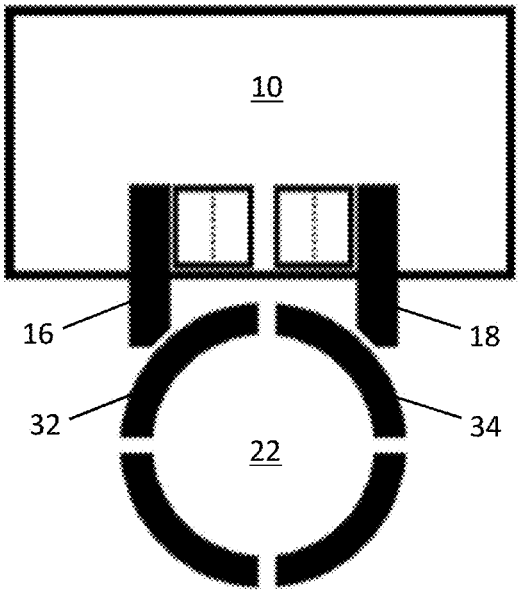
FIG. 9 is a cross section view depicting the engagement of a chamfer on module conductors with curved outer surfaces of ferrous conductors of a power delivery module according to an exemplary embodiment.
Figure 10:
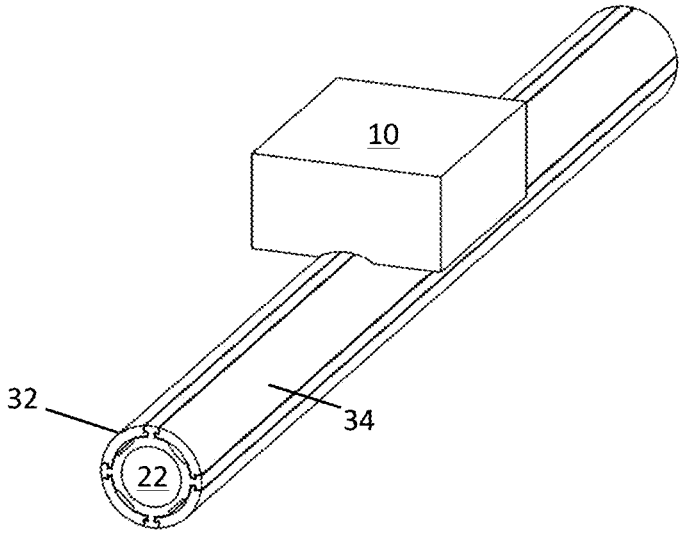
FIG. 10 shows a perspective view of the modules shown in cross section in FIG. 9.

The chamfer 28 may be configured to engage a power delivery module or other module having a non-coplanar orientation of conductors, such as, for example, a round module, a module with a triangular, diamond or other polygon profile, etc. For example, FIG. 9 depicts the engagement of a chamfer on module conductors 16 and 18 with the curved outer surfaces of ferrous conductors 32 and 34 of a power delivery module 22. FIG. 10 shows a perspective view of the modules 10 and 22 shown in cross section in FIG. 9.

Figure 11:
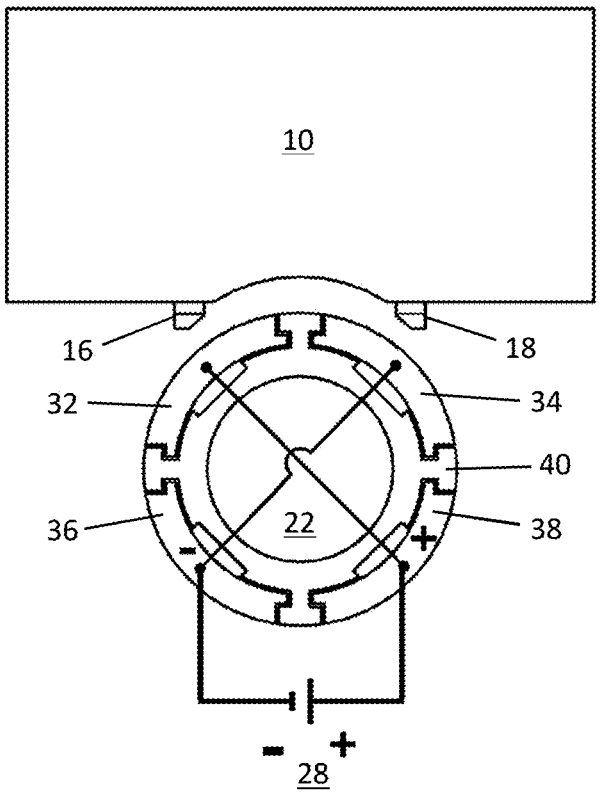
FIG. 11 is a cross section view of a functional module and a power delivery module with four conductors according to an exemplary embodiment.

In one embodiment, shown generally in FIG. 11, a power delivery module 22 includes four conductors 32, 34, 36 and 38. A module extrusion 40 (which may be formed of one or more subcomponents) provides structure to the module and also serves to electrically isolate and insulate the conductors. A power supply 28 provides power to the conductors such that conductors on opposite sides are electrically connected. For example, a positive lead of the power supply 28 may be connected to conductors 32 and 38 and a negative lead of the power supply 28 may be connected to conductors 34 and 36. In an embodiment including more than four conductors in a power delivery module, polarized power may be provided to the conductors such that every other conductor may be electrically connected to one another such that polarity among the conductors alternates around the perimeter of the power module. In a further example, multiple phase power may be provided via corresponding power delivery module conductors.

Figure 12:
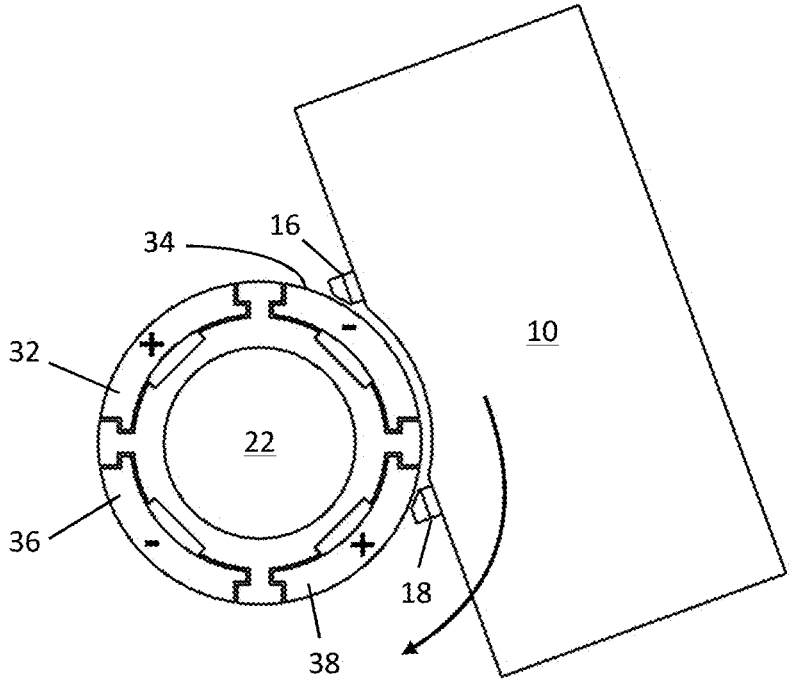
FIG. 12 is a cross section view of a functional module and a power delivery module with four power carrying conductors according to an exemplary embodiment.

As shown in FIG. 12, a functional module 10 may be configured to spin around a rod-shaped power delivery module 22. As it does so, the conductors 16 and 18 go from connecting with conductors 32 and 34, respectively, to conductors 34 and 36, respectively. Consequently, the polarity of power conducted through the functional module's conductors 16 and 18 is reversed.

Figure 43A:
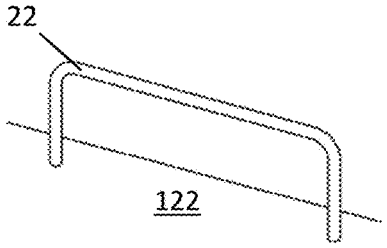
FIGS. 43*a*, 43*b* and 43*c* are perspective views of rod-shaped power delivery module configurations according to exemplary embodiments.
Figure 43B:
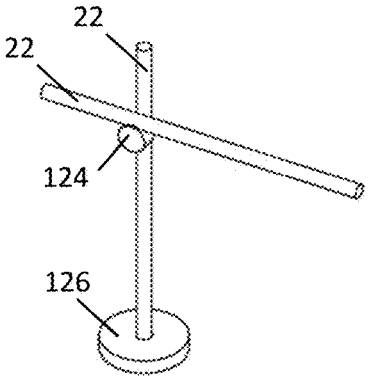
Figure 43C:
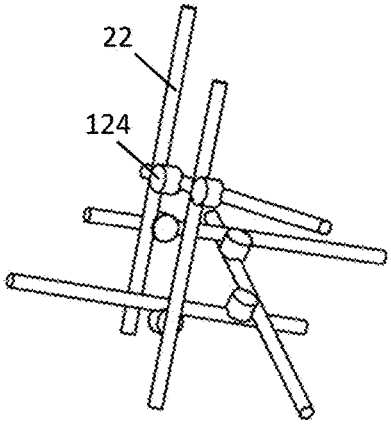

Rod-shaped power delivery modules can take many forms. For example, as shown in FIG. 43*a*, a rod-shaped power delivery module 22 may be mounted on a surface 122 and may be curved in a "D" or arch shape. In another example, shown in FIG. 43*b*, two rod-shaped power delivery modules 22 may be connected to one another via a connection module 124 and may rest on a base 126 to form a lamp structure. In yet another example, shown in 43*c*, a plurality of rod-shaped power delivery modules 22 may be connected to one another via connection modules 124 to form a 3D free form structure that may be hanging or free-standing.

Figure 13:
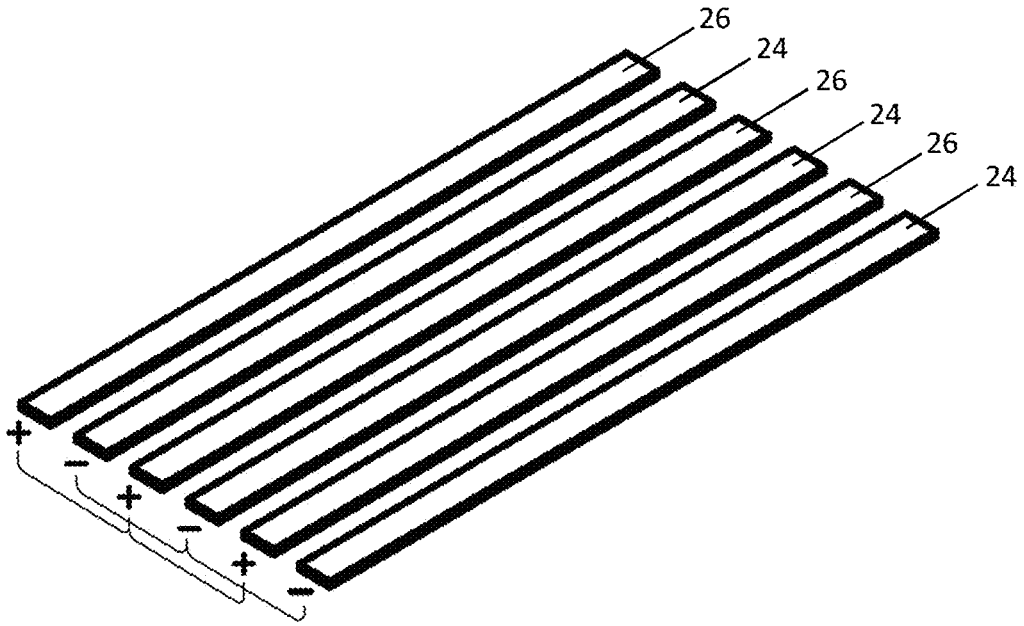
FIG. 13 shows an example of an array of conductors in a power delivery module according to an exemplary embodiment.

In another embodiment, shown generally in FIG. 13, a power delivery module with flat conductors may include an array of more than two conductors 24 and 26 of alternating polarity.

Figure 14A:
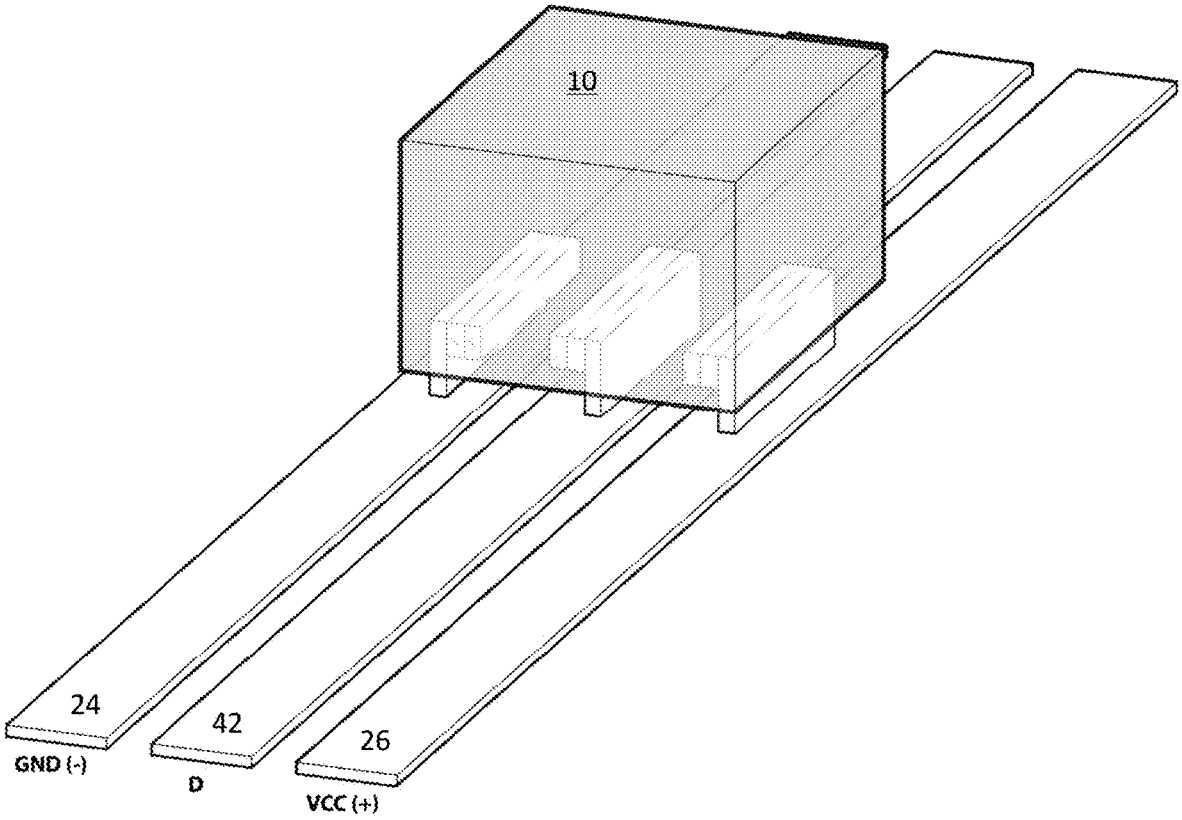
FIGS. 14*a* and 14*b* show an example of modules having three conductors according to an exemplary embodiment.
Figure 14B:
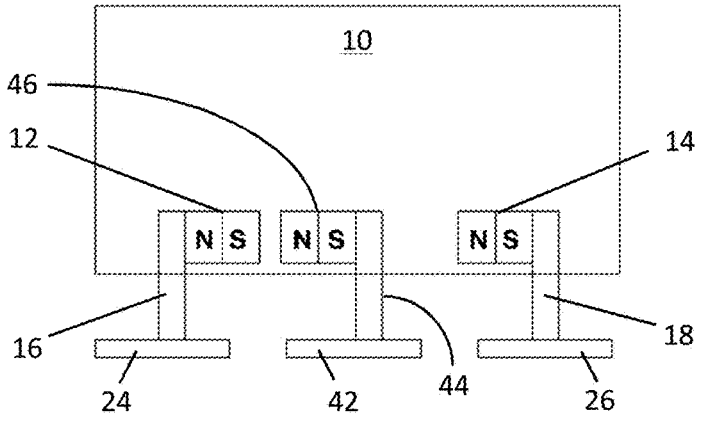

In another embodiment, shown generally in FIG. 14*a*, a power delivery module may include an array of three conductors 24, 26 and 42. Although depicted as flat conductors, they need not be. In the example shown, conductors 24 and 26 may be configured to provide power (e.g., ground (−) and VCC (+), respectively) as well as a conductor 42 devoted to data transmission. FIG. 14*b* shows a possible arrangement of magnets 12, 14 and 46 among conductors 16, 18 and 44, respectively, within the functional module 10 shown in FIG. 14*a*.

Figure 15A:
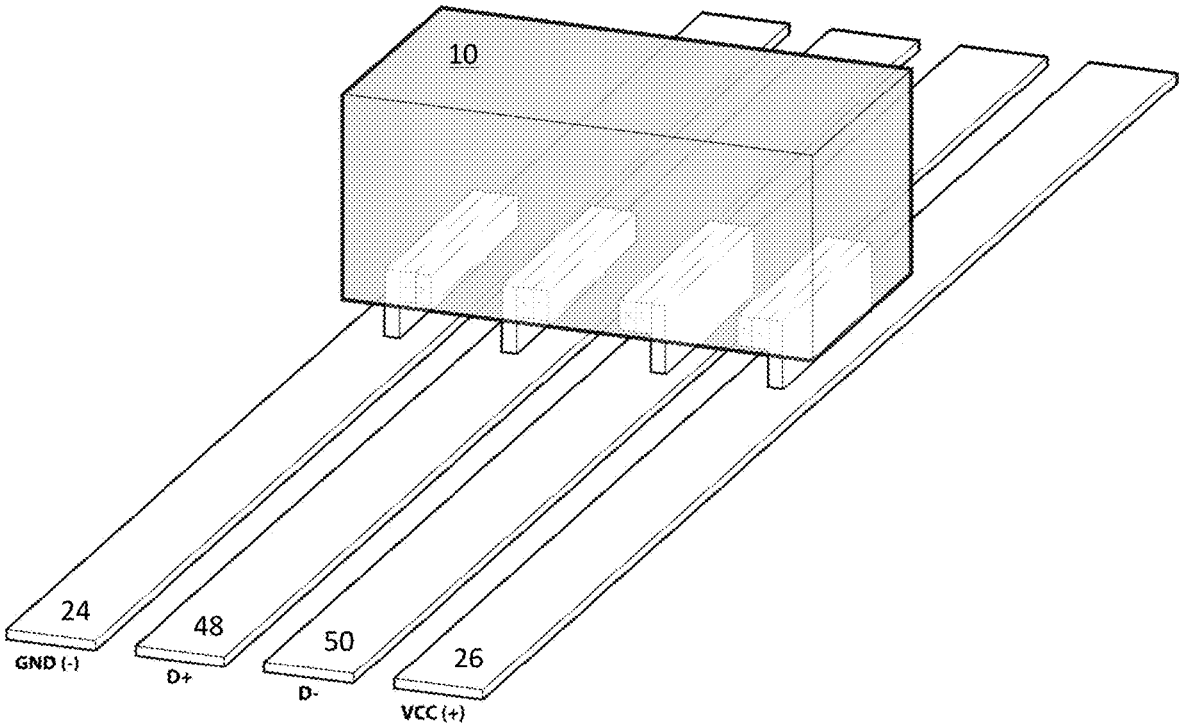
FIGS. 15*a* and 15*b* show an example of modules having four conductors according to an exemplary embodiment.
Figure 15B:
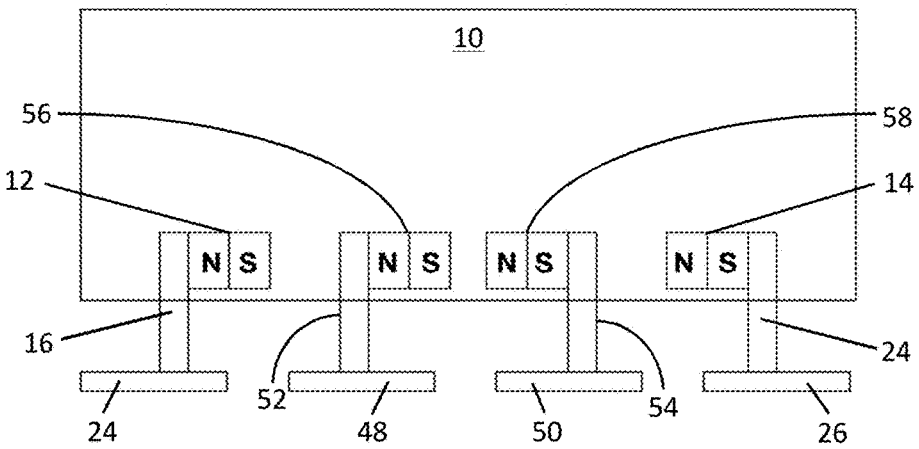

In another embodiment, shown generally in FIG. 15*a*, a power delivery module may include an array of four conductors 24, 26, 48 and 50. Although depicted as flat conductors, they need not be. In the example shown, conductors 24 and 26 may be configured to provide power (e.g., ground (−) and VCC (+), respectively) as well as two conductors 48 and 50 devoted to data transmission (e.g., D+ and D−, respectively). FIG. 14*b* shows a possible arrangement of magnets 12, 14, 56 and 58 among conductors 16, 18, 52 and 54, respectively, within the functional module 10 shown in FIG. 15*a*. In one example, the four conductors of the modules may be configured to operate in accordance with the USB protocol.

Figure 16A:
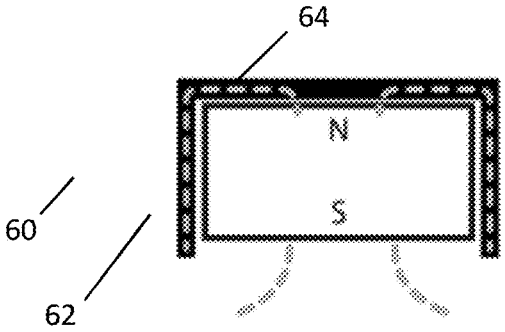
FIGS. 16*a* and 16*d* are cross section views of conductor projections of functional modules according to exemplary embodiments.
Figure 16B:
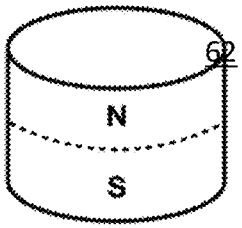
FIGS. 16*b* and 16*c* are perspective views of magnets for use within conductor projections of functional modules according to exemplary embodiments.
Figure 16C:
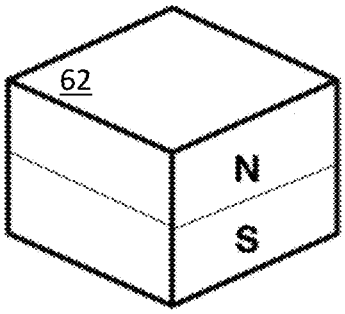
Figure 16D:
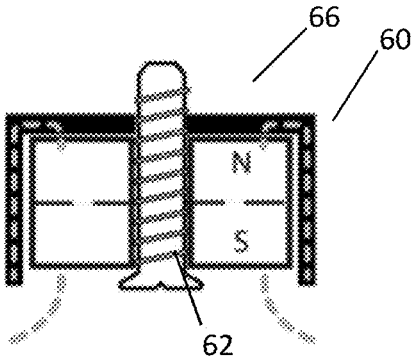
Figure 16E:
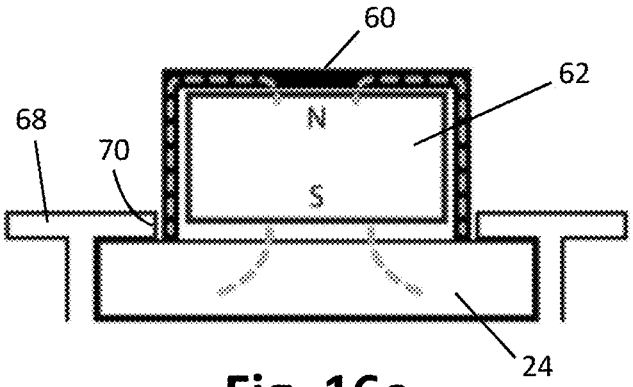
FIG. 16*e* is a cross section view of a conductor projection engaging with a power delivery module according to an exemplary embodiment.

In the example shown in FIG. 3, functional module conductors 16 and 18 take the form of flat, blade-like conductors. In the example shown in FIG. 16*a*, a conductor of a functional module may take the form of a ferrous metal cover 60 over a magnet 62 protruding from a surface of the functional module. For example, a conductor projection may include a cylindrical magnet (as shown in FIG. 16*b*), a rectangular magnet (as shown in FIG. 16*c*) or a toroidal magnet with a center hole (as shown in FIG. 16*d*) encased by a ferrous metal cap. An end surface 64 of the cap may either be oriented towards the functional module or away from it. In addition, a magnet of a conductor projection may be fully encased by the ferrous cap. A conductor projection may be adhered to a functional module via an adhesive and/or may be mechanically fixed to the functional module, for example, by a screw 66 (as shown in FIG. 16*d*). As shown in FIG. 16*e*, a conductor projection may be attracted to (via magnetic attraction) and contact a power delivery module conductor 24 (to conduct electricity and/or data). The sides of the projection may be configured to fit within openings 70 in an insulative body 68 of a power delivery module, as shown in FIG. 16*e*. The openings 70 may be configured to align the projection in one position or may be configured to permit movement of the projection along the power delivery module conductor 24.

Figure 17A:
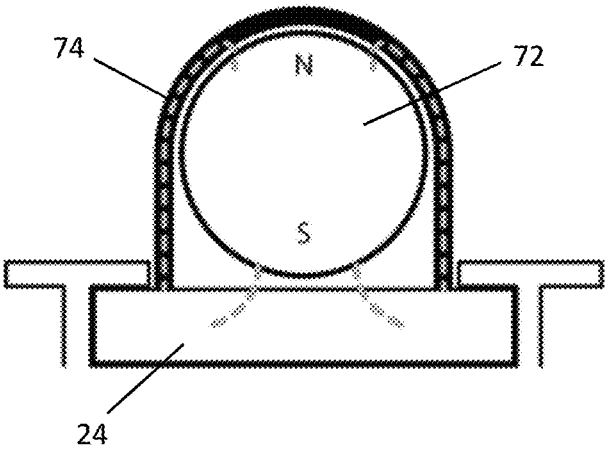
FIG. 17*a* is a cross section view of a conductor projection engaging with a power delivery module according to an exemplary embodiment.
Figure 17B:
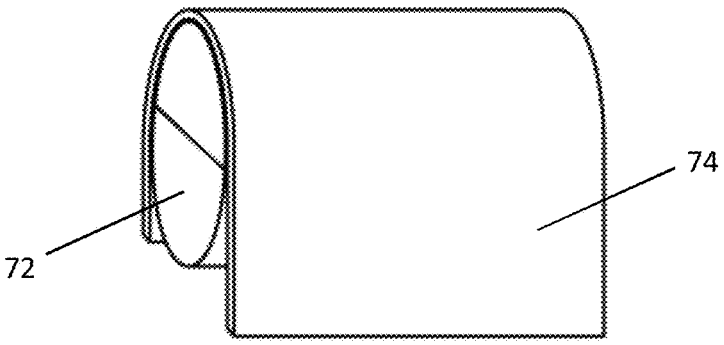
FIG. 17*b* is a perspective view of a conductor projection according to an exemplary embodiment.

In another example, shown in FIGS. 17*a* and 17*b*, a projection of a functional module may include a cylindrical magnet 72 oriented with its axis generally parallel to a surface of a mating power delivery module conductor 24. The cylindrical projection may be wrapped with a ferrous cap 74 along its circumference and optionally also about its circular ends. The polarity of the magnet 72 may be as shown in FIG. 17*a* or may be rotated + or −90 degrees such that an imaginary line connecting the north and south poles is generally parallel with a surface of conductor 24.

Generally, functional modules may be provided with at least one conductor for each conductor of a power delivery module that needs to be contacted to ensure proper function of the functional module and its circuitry. For example, if a functional module needs two conductors to receive power for circuitry comprising a light, the functional module will include at least two conductors or conductor projections. However, functional modules may be configured with more than the minimum number of conductors (which may take the form of conductor projections). Such extra conductors may be configured to provide redundant connections to power delivery module conductors (two or more functional module conductors contact the same power delivery module conductor) and/or extra functional module conductors may be configured to contact power delivery module conductors not necessary for function of the functional module's circuitry. For example, the functional module 10 of FIGS. 14*a* and 14*b* may be a simple light that only needs a connection to power delivery conductors 26 and 26. The conductor 44 may have no electrical purpose with respect to the light, yet may be included in the functional module anyway, for example to provide increased magnetic attraction, for cosmetics, to provide future circuitry upgrade potential, etc.

Figure 18A:
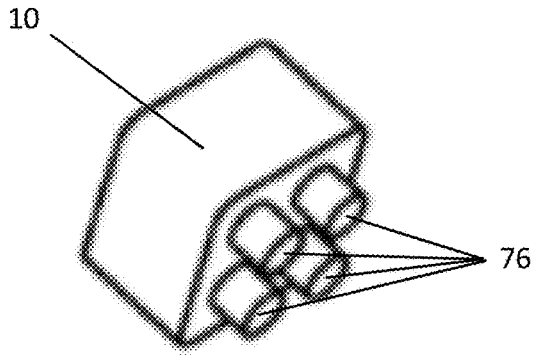
FIG. 18*a* is a perspective view of a functional module according to an exemplary embodiment.
Figure 18B:
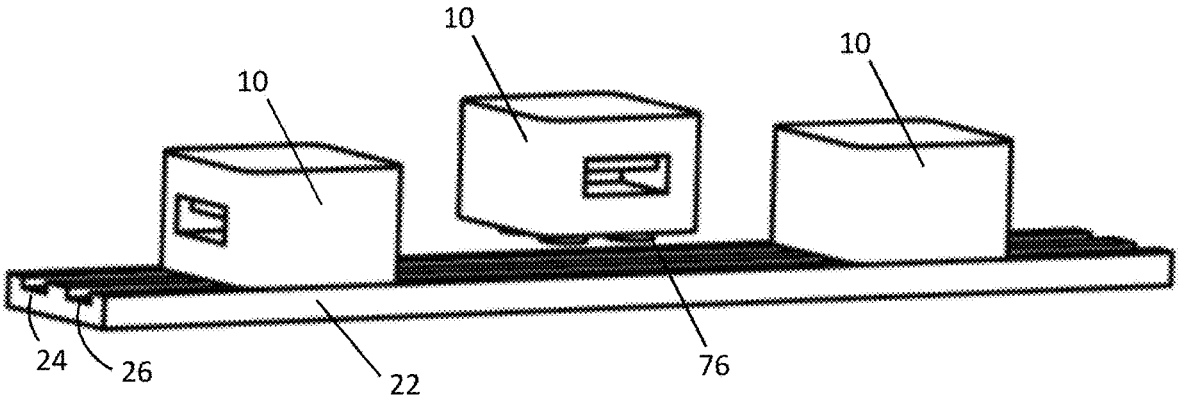
FIG. 18*b* is a perspective view of functional modules engaging with a power delivery module according to an exemplary embodiment.

In one example, shown in FIG. 18*a*, a functional module 10 includes four cylindrical conductor projections 76. FIG. 18*b* shows three functional modules of the type shown in FIG. 18*a*, oriented in different directions along a power delivery module 22. In each orientation, different of the projections 76 contact (or are nearly contacting) the different conductors 24 and 26 of the power delivery module 22.

Figure 19:
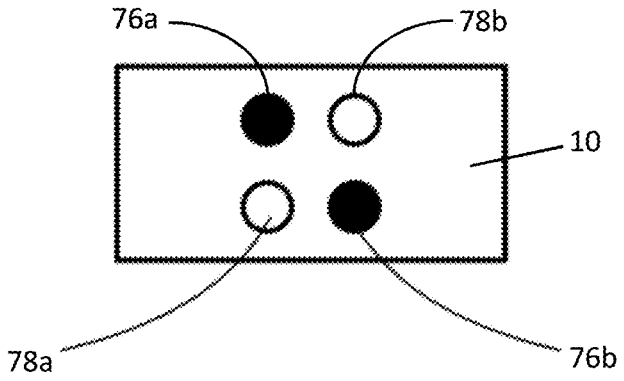
FIG. 19 is a bottom view of a functional module according to an exemplary embodiment.

In another example, a functional module includes one or more electrically conductive projections and one or more projections that are not electrically conductive. Such "dummy" projections may be used to provide positional stability or to assist in orienting the functional module with respect to a power delivery module. For example, as shown in FIG. 19, one side of a functional module 10 may include two electrically conductive projections 76 (for example, of the type shown in FIG. 17*a*) and two dummy projections 78 that are not electrically conductive. In one example, the dummy projections 78 may be integrally formed along with a housing of the functional module from injection molded plastic.

Figure 20:
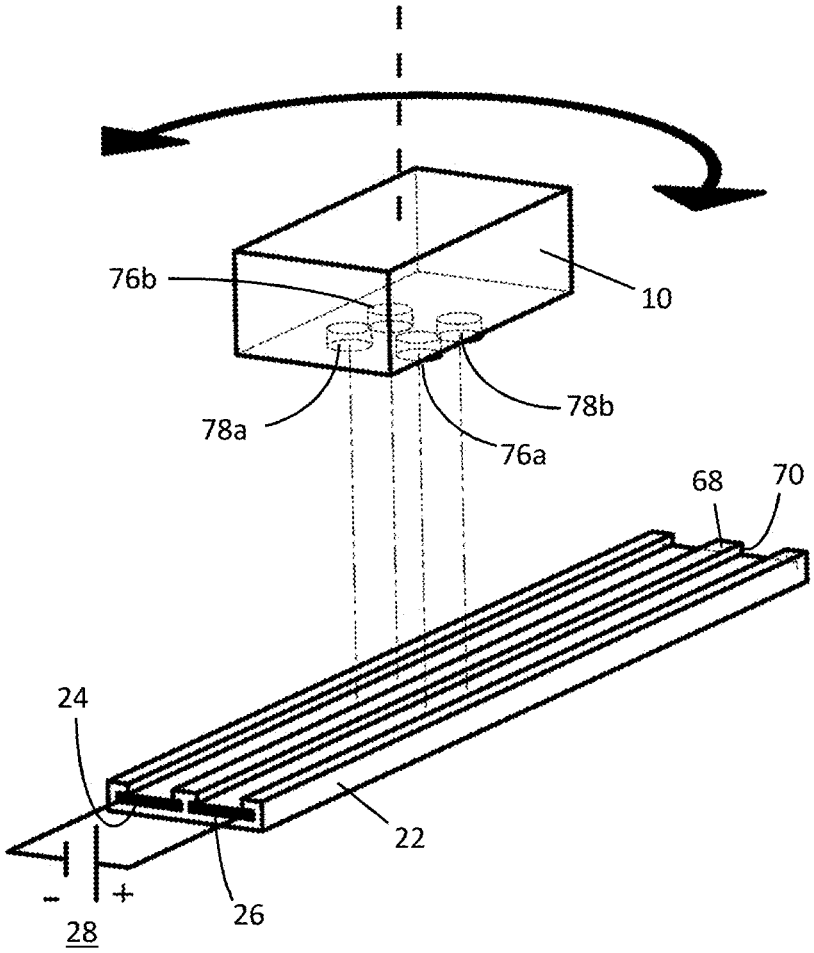
FIG. 20 is a perspective view of a functional module engaging with a power delivery module according to an exemplary embodiment.

In the example shown in FIG. 20, projections 76*b* and 78*a* of the functional module may initially be aligned with and contact conductor 24 of the power delivery module 22. Likewise, projections 76*a* and 78*b* may initially be aligned with and contact conductor 26. In this arrangement, projection 76*a* is connected to the positive lead of power supply 28 and projection 76*b* is connected to its negative lead. The sidewalls of opening 70 in the insulative web 68 of the power delivery module 22 keep the projections aligned along the respective conductors 24 and 26. The functional module is free to slide along the power delivery module while maintaining electrical connection, but the functional module is not free to rotate while electrically connected to the power delivery module. However, if a user removes the functional module from the power delivery module and rotates it 90, 180 or 270 degrees, the projections are arrayed such that functional module is re-attachable to the power delivery module in a different rotational orientation. If the user rotates the functional module 90 or 270 degrees (clockwise or counterclockwise), different polarity power will be received by the functional module. For example, as shown in FIG. 20, if the functional module 10 is rotated 90 degrees clockwise, projection 76*a* will be connected to the negative lead of power supply 28 through conductor 24 and projection 76*b* will be connected to the positive lead of power supply 28 through conductor 26.

In one example, turning a functional module to a different orientation along a power delivery module triggers an event or changes a feature of the functional module. For example, turning a functional module with a light 90 degrees may cause the light to dim, brighten or turn off, depending on a configuration of the module. Similarly, translational movement of a functional module along a power delivery module may be configured to trigger an event or change a feature of the functional module. For example, sliding a functional module with a light from one end of a power delivery module to the other end may cause the light to gradually dim or brighten.

In another example, portions of the power delivery module may be configured to cause predetermined effects in functional modules attached at those portions. For example, one section of a power delivery module may be configured with ferrous strips that are not connected to a power supply, resulting in accessories being unpowered when attached to that portion of the power delivery module.

Figure 21:
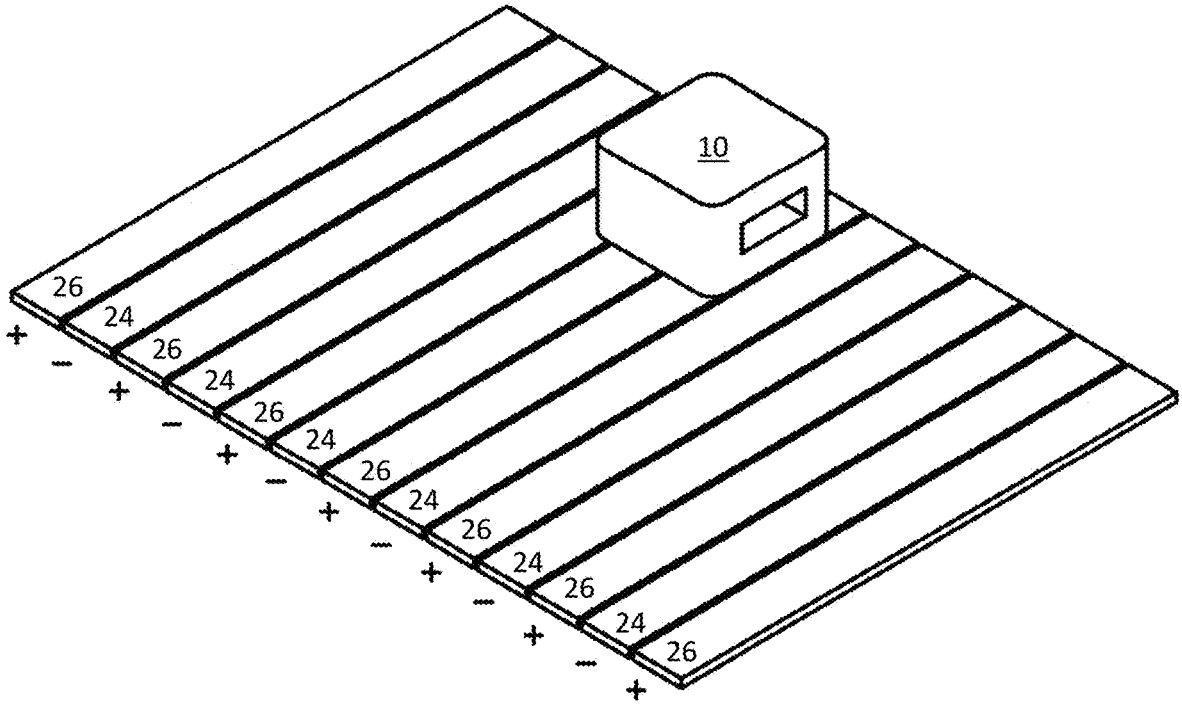
FIG. 21 is a perspective view of a functional module engaging with an array of conductors of a power delivery module according to an exemplary embodiment.

In another example, a power delivery module may include more conductors than functional modules have conductors. In this example, functional modules are connectable to different conductors of the power delivery module depending on a selection of a user and may receive power in each chosen position. FIG. 21 shows an example of an array of power delivery module conductors 24 and 26 arranged in alternating fashion. As shown, the conductors 24 and 26 may provide alternating connections to the negative and positive leads, respectively, of a power supply. All similar conductors may be connected with one another (e.g. all negative conductors 24 may be electrically bonded together) or may be isolated from one another. For example, different power supplies 28 may be connected to different conductors 24 and 26. In another example, all negative conductors 24 may be bonded, but conductors 26 may be attached to different power supplies 28, for example of different voltages and/or with different current delivery characteristics. In yet another example, arrayed conductors of a power delivery module may be of three or more types, for example to support functional modules that include more than three conductors such as those shown in FIGS. 14*a*, 14*b*, 15*a* and 15*b*.

Figure 22:
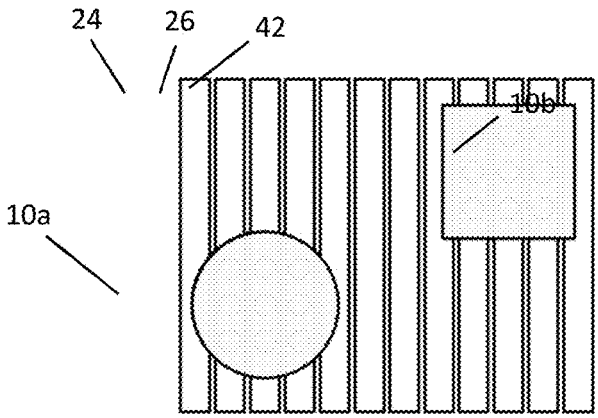
FIG. 22 is a top view of functional modules engaging with an array of conductors of a power delivery module according to an exemplary embodiment.
Figure 23:
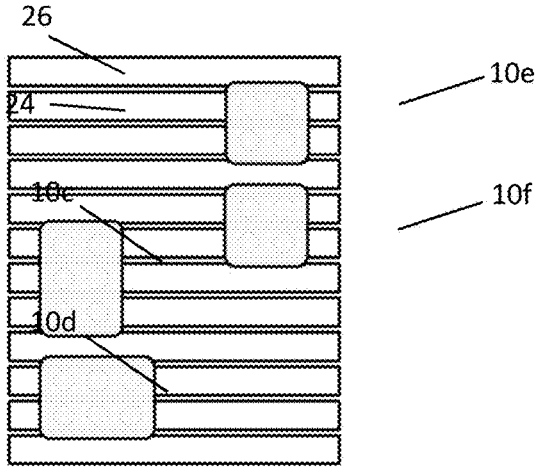
FIG. 23 is a top view of functional modules engaging with an array of conductors of a power delivery module according to an exemplary embodiment.

As shown in FIGS. 22 and 23, multiple functional modules 10*a*, 10*b*, 10*c*, 10*d*, 10*e* and 10*f* may be connected to an array of conductors in a power delivery module. In FIG. 22, three types of conductors 24, 26 and 42 are arrayed to support functional modules 10*a* and 10*b*, which each include cylindrical conductor projections to connect with three different types of conductors.

Figure 24:
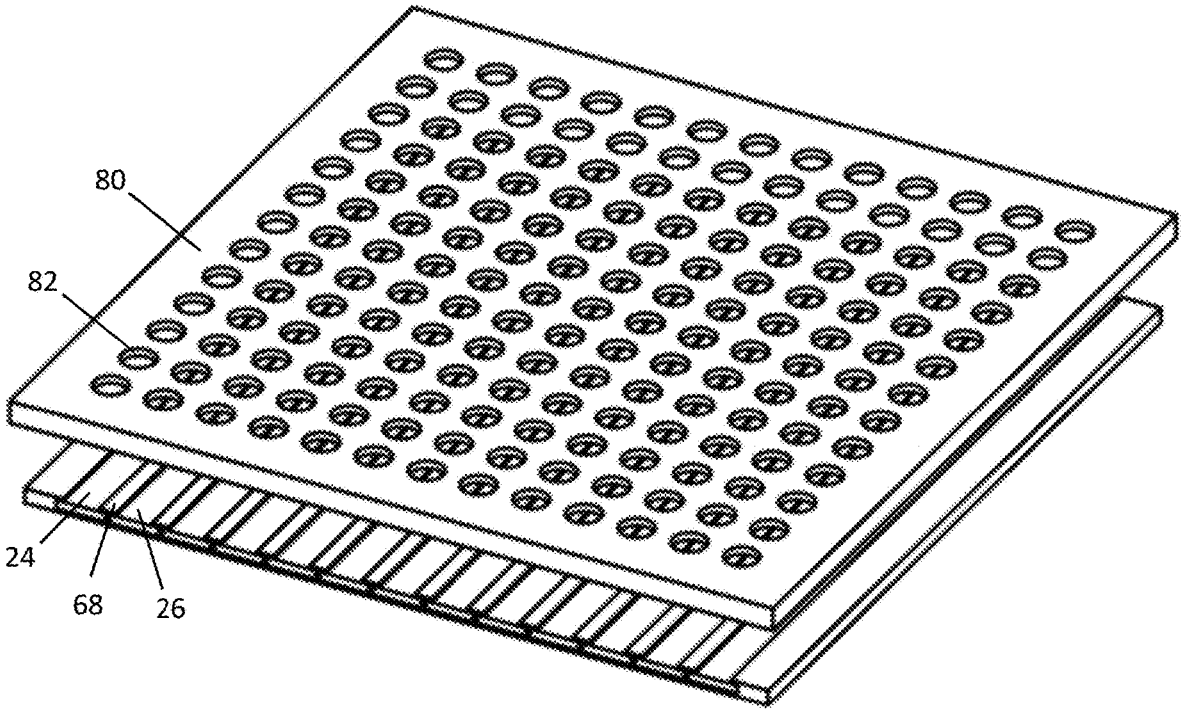
FIG. 24 is a perspective view of components of a power delivery module according to an exemplary embodiment.

In FIG. 24, an exemplary power delivery module is shown with a non-conducting cover 80 about to be affixed to a base comprising an insulative web 68 and conductors 24 and 26. The cover 80 includes holes 82 configured to accept projections of functional modules. The cover 80 may be configured to conceal from a user which holes correspond to which conductors and to present a visually uniform array of projection reception positions defined by the holes. In another example, the cover, holes and/or the conductors may be configured to visually signal which conductors are underneath which holes.

In one aspect, holes 82 in a cover may be configured with locking features that allow projections of a functional module to be mechanically locked to the cover and thus the power delivery module. For example, as shown in FIG.

Figure 25A:
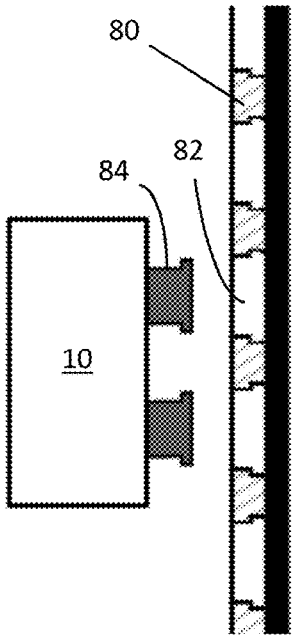
FIGS. 25*a*-25*c* are cross section views of a functional module engaging with a power delivery module according to an exemplary embodiment.
Figure 25B:
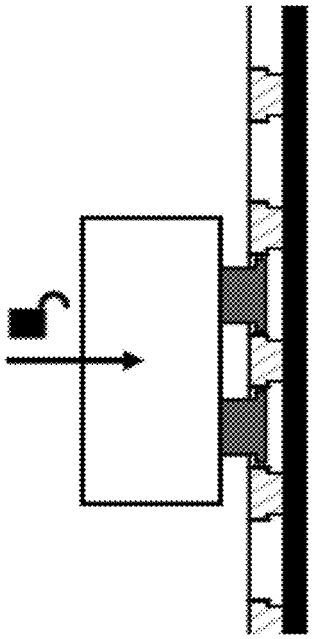
Figure 25C:
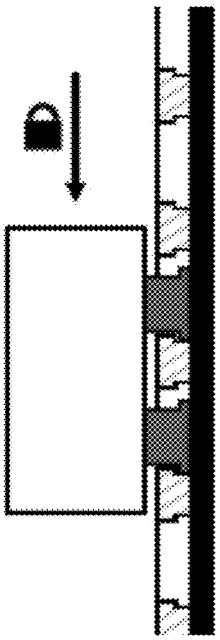
Figure 26A:
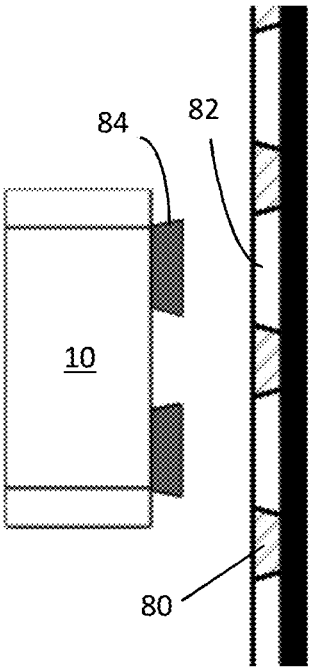
FIGS. 26*a*-26*c* are cross section views of a functional module engaging with a power delivery module according to an exemplary embodiment.
Figure 26B:
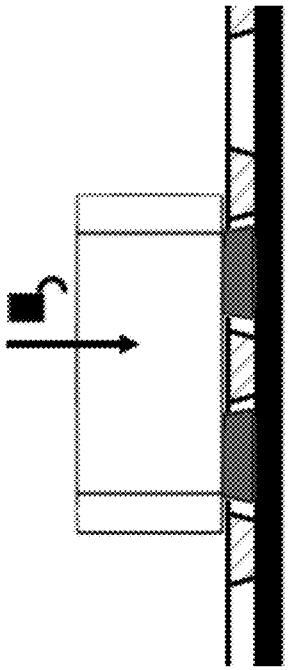
Figure 26C:
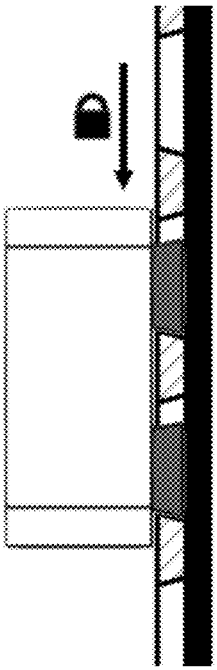
Figure 27A:
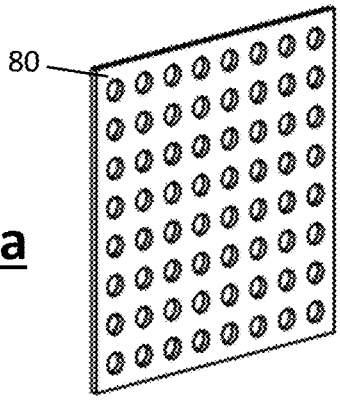
FIGS. 27*a*-27*d* are perspective views of various power delivery module covers according to exemplary embodiments.
Figure 27B:
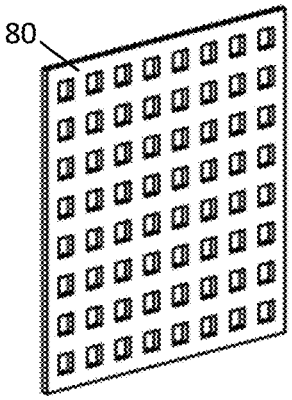
Figure 27C:
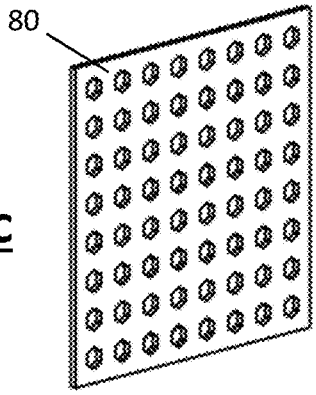
Figure 27D:
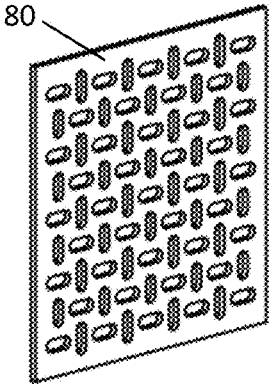

25*a-c*, projections 84 may include a stepped "nailhead" which is configured to be received by holes 82 (FIG. 25*b*) and then be locked in when the functional module 10 is shifted laterally by virtue of the projection nailheads engaging with corresponding undercuts in the cover 80. In another example, shown in FIGS. 26*a*-26*c*, projections 84 may be frustoconical and holes 82 may be correspondingly tapered.

The shapes of the holes 82 in covers 80 may correspond to the shape of projections of functional modules (e.g., cylindrical holes and projections) or may be dissimilar from them (e.g., cylindrical projections and square holes). FIGS. 27*a-d* show examples of covers 80 with cylindrical holes, square holes, hexagonal holes and slot-shaped holes with alternating orientations of their long axes, respectively.

Figure 51:
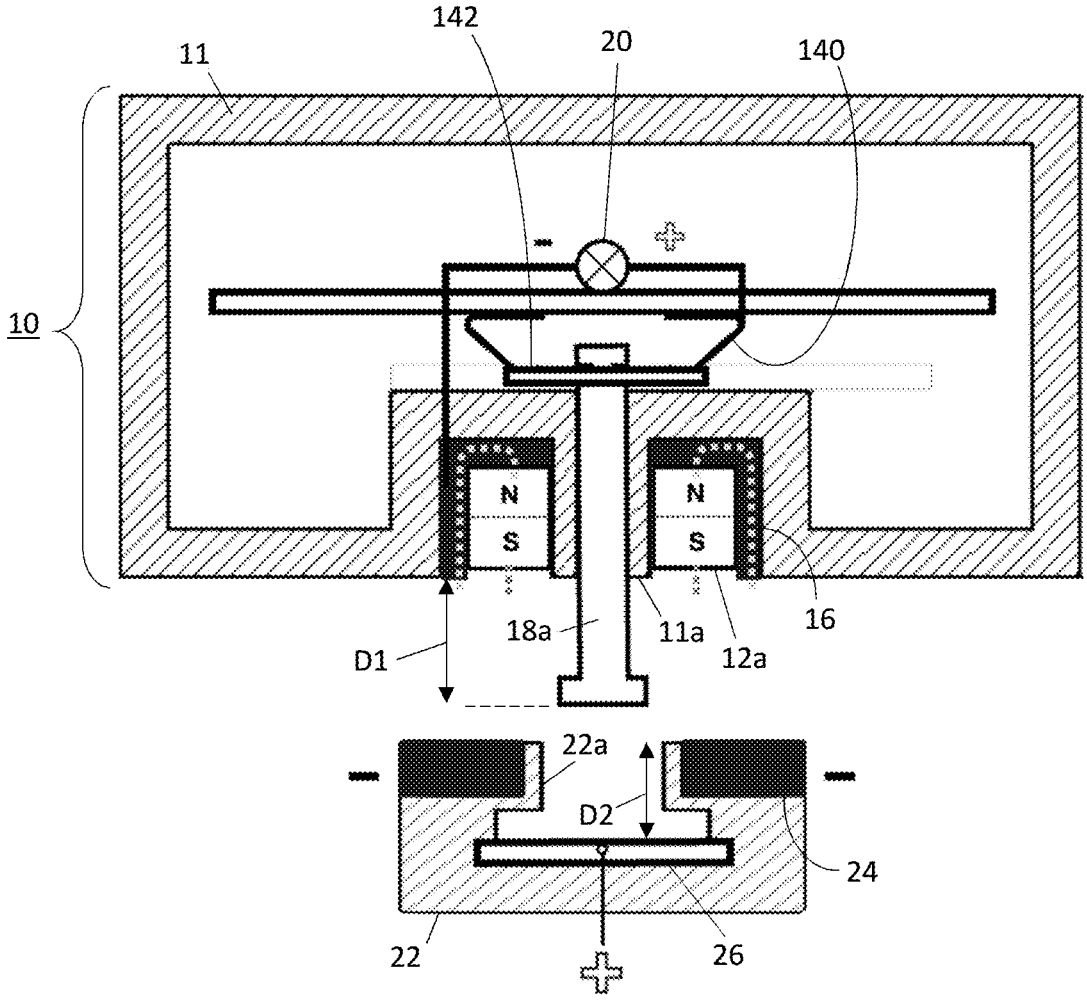
FIG. 51 is a cross section view of a functional module adjacent a power delivery module according to an exemplary embodiment.

In another example, one or more conductors of a functional module may be formed as a movable or stationary peg, as shown generally in FIG. 51. In this example, the peg 18*a* may be formed of conductive material, which may or may not be ferrous. As shown in FIG. 51, the peg may be surrounded or flanked by one or more magnets 12*a*. In one example, magnet 12*a* is a toroidal magnet. The peg 18*a* may be configured with any of a variety of profiles. In one example, peg 18*a* may be configured as a round peg, with generally rotationally symmetric features. Other profiles for the peg 18*a*, such as those shown and described above with regard to FIGS. 25*a*-27*d*, are also possible. As shown in FIG. 51, the peg 18*a* may be electrically isolated from the magnet 12*a* by insulation 11*a* (which may be comprised of solid material, air, or other electrically insulative material) that may or may not be contiguous with a housing 11 of the functional module 10. Similarly or alternatively, conductor 16 may be electrically isolated from magnet 12*a* by an electrically insulative material.

In the example shown in FIG. 51, a conductor 16 is configured adjacent to the magnet 12*a* and may be configured to protrude slightly from one surface of the functional module. In such an arrangement, conductor 16 may be formed of a ferrous material and be configured such that a magnetic field of the magnet 12*a* is conducted through the conductor 16, acting to attract the conductor 16 to a mating ferrous conductor(s) 24 of a power delivery module. In another example, the conductor 16 may or may not be formed of ferrous material but the peg 18*a* is comprised of a ferrous material such that a magnetic field of the magnet 12*a* is conducted through the peg 18*a* regardless of the material of the conductor 16. Although depicted such that the magnet 12*a* is situated between the peg 18*a* and the conductor 16, it is also possible to configure the magnet 12*a* outside the conductor 16, such that the conductor 16 is situated between the peg 18*a* and the magnet 12*a*. In this configuration, an insulative material (which may be comprised of solid material, air, or other electrically insulative material) electrically separates the peg 18*a* from the conductor 16.

In the example shown in FIG. 51, the peg 18*a* is movable along its axis (up and down in FIG. 51). The peg 18*a* may be biased to extend away from the functional module 10 by a biasing member 140 such as a spring, also having the effect of resisting the peg's movement into an interior of the functional module. Such a biasing member could take the form of, for example, a coil spring, a leaf spring, a wave spring, or any combination thereof. To retain the peg 18*a* within the functional module 10, a retaining member 142 such as an E clip retaining ring, pin, or other member may be attached or affixed to a portion of the peg 18*a*. Alternatively, or in combination, the geometry of the peg 18*a* may be configured to provide such retention, for example by an enlarged end portion of the peg 18*a* being configured such that it prevents the peg from sliding out of the functional module completely. The biasing member may be formed of electrically conductive material and electrically connected to circuitry 20 within the functional module such that the biasing member is configured to provide at least a portion of an electrically conductive path from the peg 18*a* to the circuitry 20.

Figure 52:
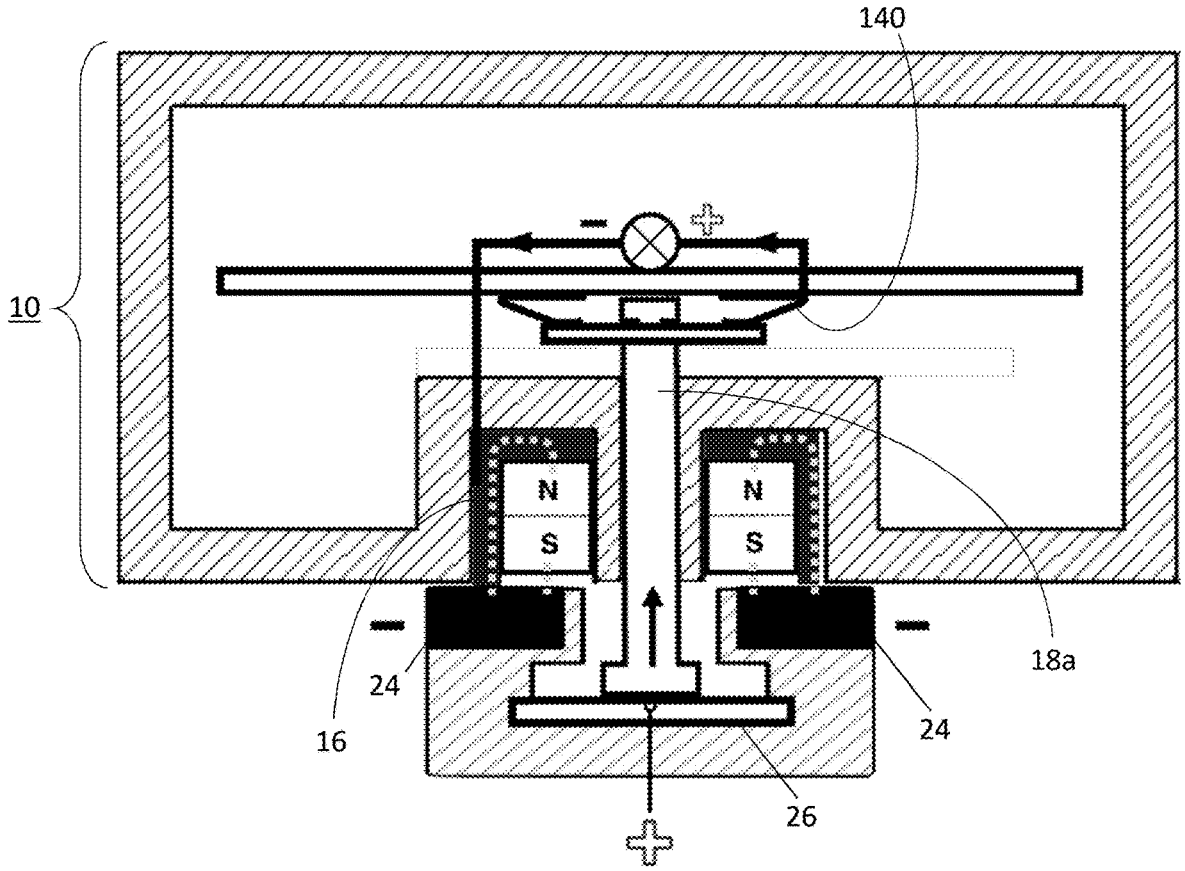
FIG. 52 is a cross section view of the exemplary modules shown in FIG. 51 in an attached configuration.

FIG. 52 shows a cross section view of the example shown in FIG. 51 in an attached configuration. As shown, when the functional module 10 is attached to the power delivery module, the peg 18*a* contacts conductor 26 and moves axially into the functional module 10, compressing the biasing member 140. The peg 18*a* may be configured such that it protrudes from the functional module a greater distance (D1 in FIG. 51) than the distance between contact surfaces (of conductors 24 and 26) of a mating power delivery module (D2 in FIG. 51). In this configuration, upon attachment, the peg 18*a* will contact conductor 26 first, then, as the biasing member 140 is compressed (aided by the magnetic attraction between conductor 16 and conductor 24 (if they are ferrous) and/or between peg 18*a* and conductor 26 (if they are ferrous)) conductor 16 and conductor 24 eventually contact each other.

The strength of the magnetic attraction between the functional module 10 and the power delivery module may be configured to be greater than, equal to or less than the force exerted by the biasing member 140 on the peg 18*a*. If the magnetic attraction is configured to be less than the force exerted by biasing member 140, then the electric conductivity will either be momentary, as a user pushes functional module 10 against the power delivery module to overcome the force supplied by biasing member 140, or a physical retention feature may be provided to hold the functional module 10 against the power delivery module.

Figure 53A:
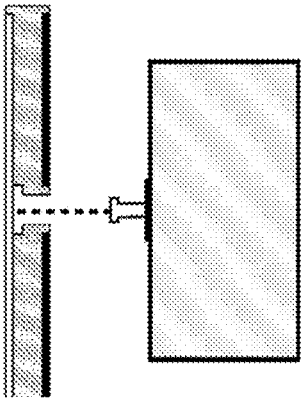
FIG. 53*a*-*c* are cross section views of a functional module attachment and locking sequence.
Figure 53B:
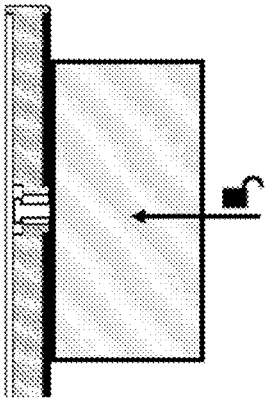
Figure 53C:
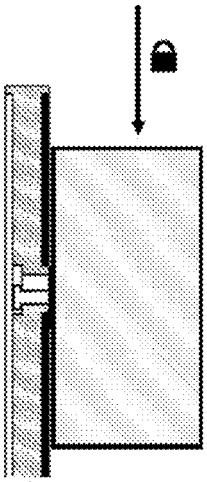

Similar to the examples shown in FIGS. 25*a*-27*a*, the peg 18*a* may be provided with a "nailhead" that may be configured to reside within a corresponding slot or cavity in the power delivery module. As shown in the exemplary cross sectional diagram of FIGS. 53*a-c*, the functional module 10 may be permitted to slide in a radial direction after the peg 18*a* is inserted into the power delivery module, locking the functional module 10 to the power delivery module by an undercut surface of the power delivery module retaining a portion of the peg's nailhead.

Figure 54A:
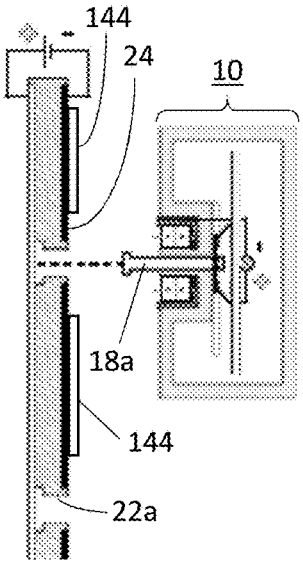
FIG. 54*a* is a cross section view of an exemplary functional module and power delivery module according to an exemplary embodiment.
Figure 54B:
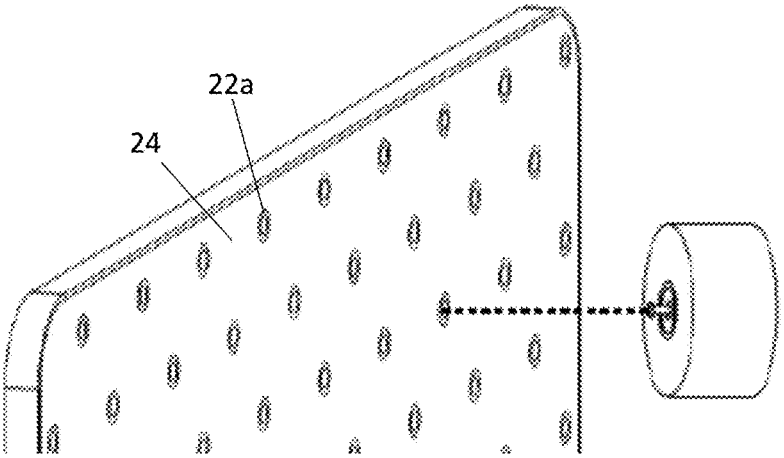
FIG. 54*b* is a perspective view of the exemplary functional module and power delivery module according to the exemplary embodiment shown in FIG. 54*a*.
Figure 54C:
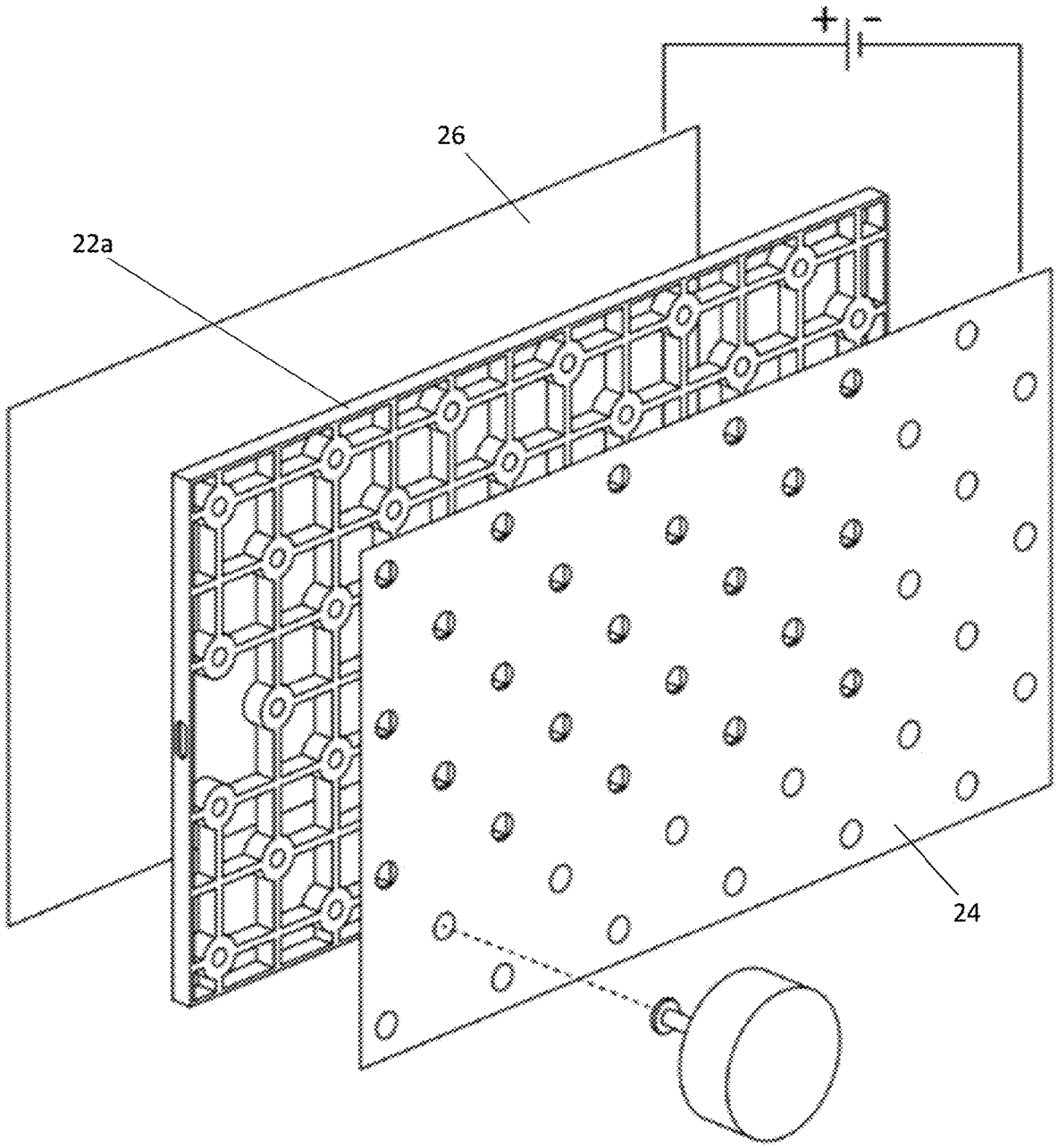
FIG. 54*c* is an exploded perspective view of the exemplary functional module and power delivery module according to the exemplary embodiment shown in FIGS. 54*a* and 54*b*.

As shown in FIGS. 54*a*, 54*b* and 54*c*, a power delivery module may be configured with one or more discrete receiving sites configured to accept pegs of functional modules. In the example shown, a surface of the power delivery module is a conductor 24 comprised of a sheet of ferrous conductive material with openings therein configured to receive a portion of insulation 22*a* and, within openings in the insulation 22*a*, configured to receive pegs 18*a* of functional modules 10.

As shown in FIG. 54*a*, the external surface of conductor 24 may be electrically insulated except in areas immediately adjacent the receiving sites. In one example, the conductor 24 may be powder coated with a non-electrically conductive paint or coating 144 except in areas immediately adjacent receiving sites. In another example, a layer of electrically insulative material 144 with openings therein corresponding to receiving sites may be adhered or otherwise layered on the exterior of conductor 24.

Figure 57A:
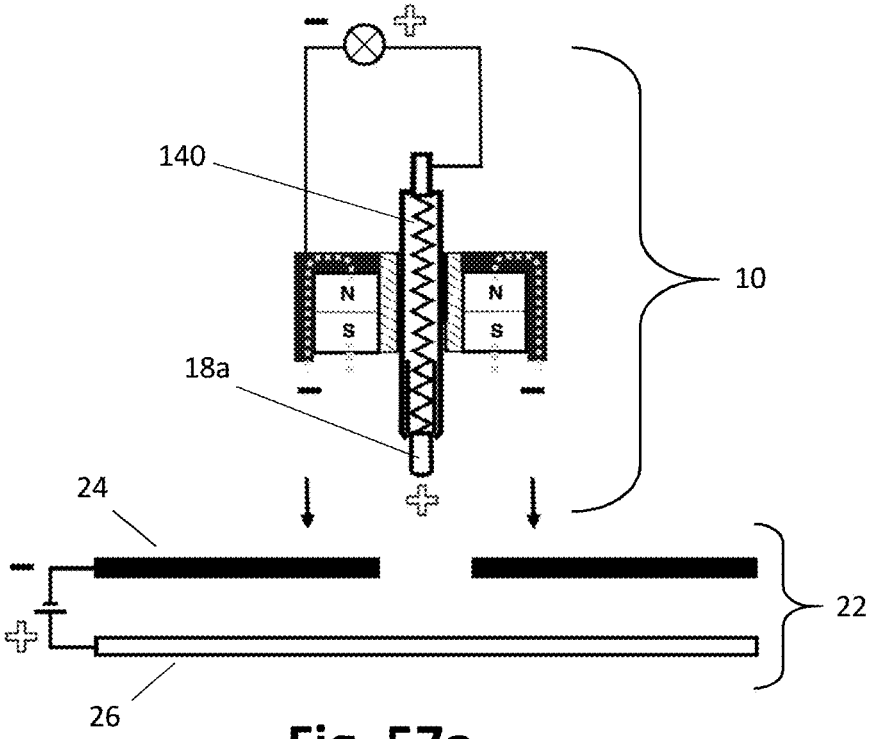
FIG. 57*a* is a cross section view of a functional module adjacent a power delivery module according to an exemplary embodiment.
Figure 57B:
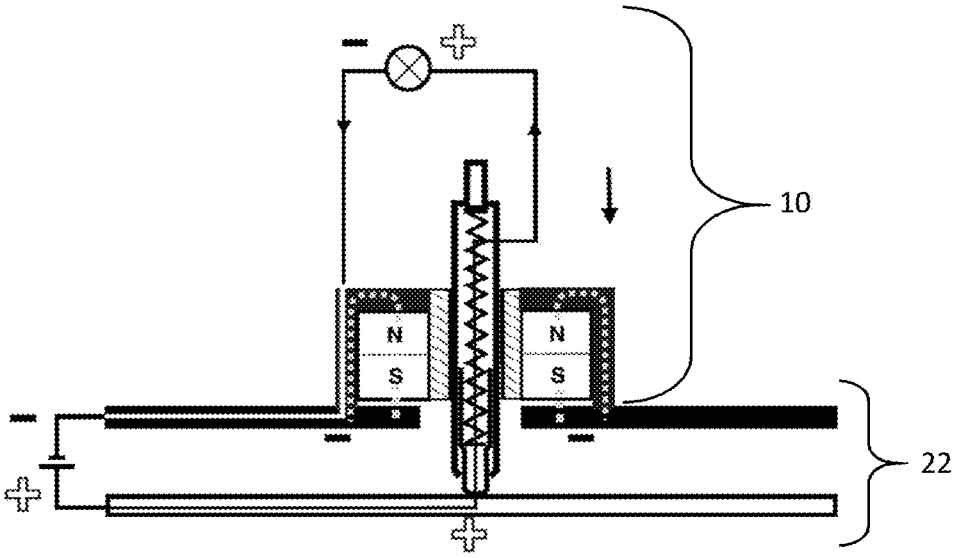
FIG. 57*b* is a cross section view of the exemplary modules shown in FIG. 57*a* in an attached configuration.

In another example, shown in FIGS. 57*a* and 57*b*, a functional module 10 may include a peg 18*a* that does not have a nailhead, but is still movable along its axis and biased towards an extended position by an internal spring 140. In this example, the magnetic attraction between the functional module 10 and the power delivery module 22 is greater than the spring's biasing force, holding the functional module 10 to the power delivery module 22 without the need for a physical locking interaction between modules.

Figure 55A:
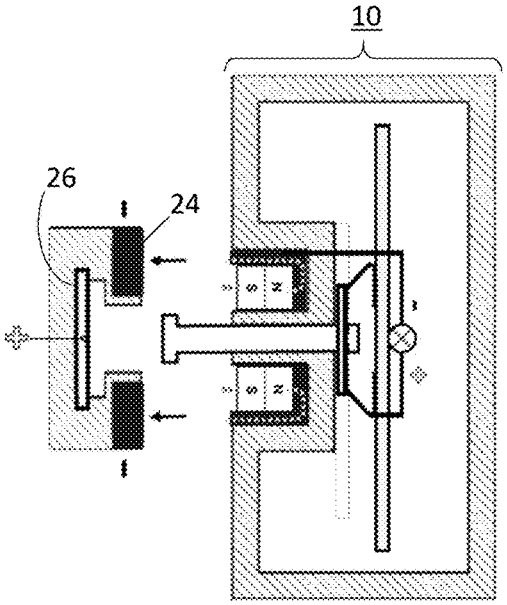
FIG. 55*a* is a cross section view of an exemplary functional module and elongate power delivery module according to an exemplary embodiment.
Figure 55B:
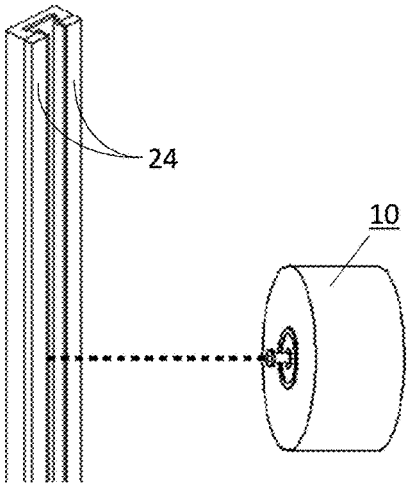
FIG. 55*b* is a perspective view of the exemplary functional module and elongate power delivery module according to the exemplary embodiment shown in FIG. 55*a*.

In another example, shown in FIGS. 55*a* and 55*b*, a power delivery module may take an elongated form and permit attachment by a functional module at any of many, non-discrete positions along its length. In this example, conductor 24 may be provided along one or both sides of an elongated trough, the bottom of which includes conductor 26.

Figure 56A:
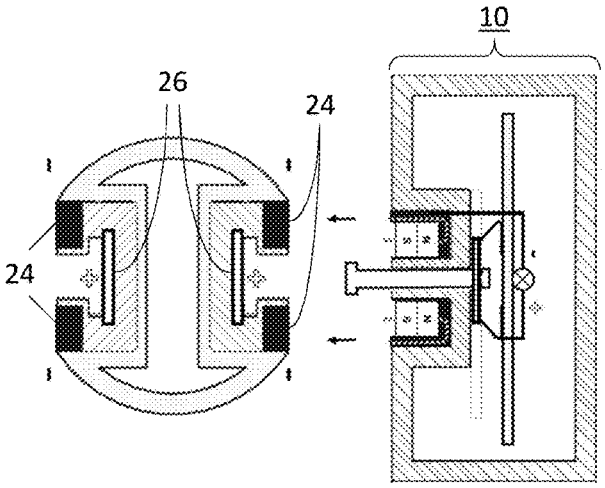
FIG. 56*a* is a cross section view of an exemplary functional module and dual-sided elongate power delivery module according to an exemplary embodiment.
Figure 56B:
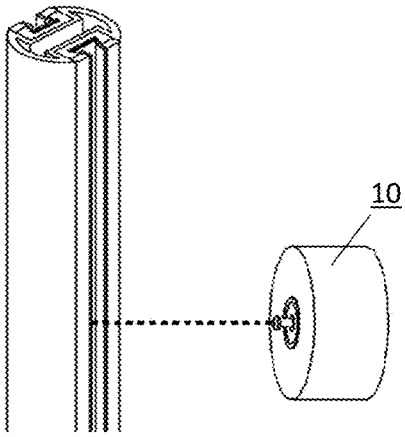
FIG. 56*b* is a perspective view of the exemplary functional module and dual-sided elongate power delivery module according to the exemplary embodiment shown in FIG. 56*a*.

In a similar example, one of which is shown in FIGS. 56*a* and 56*b*, an elongated power delivery module is provided with elongate troughs and conductors 24 and 26 at two or more positions. The conductor sets (24 and 26) may be connected to the same circuit or may be electrically segregated such that different sets of conductors perform different functions and/or are separately controllable. For example, the conductor set (24 and 26) on the left side of the cross section shown in FIG. 56*a* may be configured to provide 12 volt DC power, whereas the conductor set (24 and 26) on the right side of the cross section shown in FIG. 56*a* may be configured to provide 5 volt DC power. Alternatively, both conductor sets may be interconnected and configured to provide 5 volt DC power.

Figure 28A:
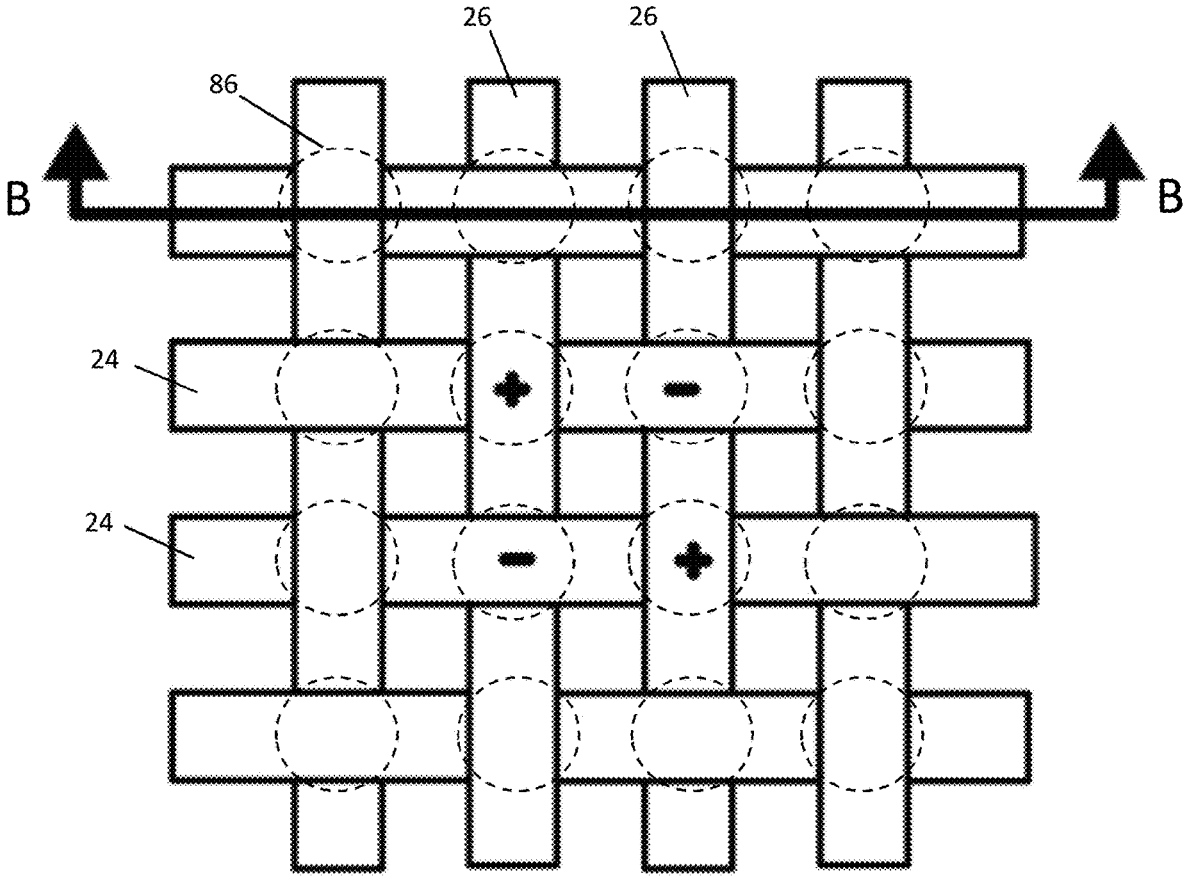
FIG. 28*a* is a top view of a power delivery module conductor array according to an exemplary embodiment.
Figure 28B:
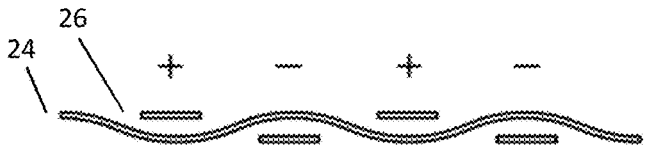
FIG. 28*b* is a cross section view of the power delivery module conductor array shown in FIG. 28*a*.
Figure 28C:
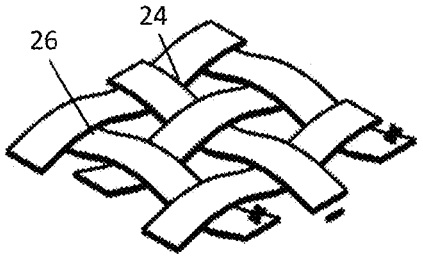
FIG. 28*c* is a partial perspective view of the power delivery module conductor array shown in FIG. 28*a*.

In another example, shown in FIG. 28*a*, conductors 24 and 26 of a power delivery module may be woven to present a checkerboard-type array of power polarities. Not shown are electrical insulators between overlapping conductors. Holes in a cover 80 may be aligned generally with the center of each conductor surface presented on one side of the woven surface, shown nominally by dotted lines 86. FIG. 28*b* shows a cross sectional view of the conductor array shown in FIG. 28*a*, taken along line B-B. FIG. 28*c* is a perspective view of a portion of the woven conductor array shown in FIG. 28*a*.

Figure 29:
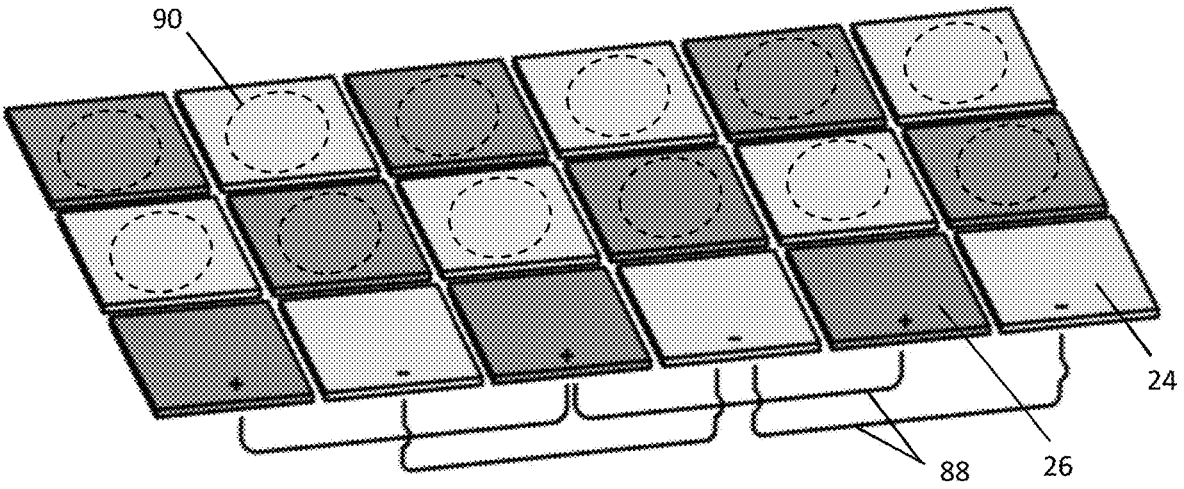
FIG. 29 is a perspective view of a power delivery module conductor array according to an exemplary embodiment.

FIG. 29 shows another example of a power delivery module conductor array with a checkerboard-type array of power polarities. In this example, conductors 24 and 26 are not woven, but are individually arrayed in a checkerboard pattern. Wiring, PC board traces, or other electrical conductor means 88 electrically connect ferrous conductors of like polarities. Holes in a cover 80 may be aligned with each conductor tile, shown nominally by dotted lines 90.

Figure 40A:
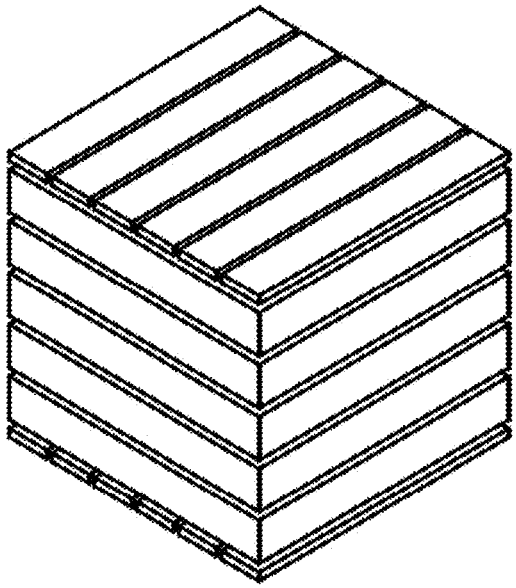
FIGS. 40*a* and 40*b* are perspective views of three-dimensional power delivery module conductor arrays according to exemplary embodiments.
Figure 40B:
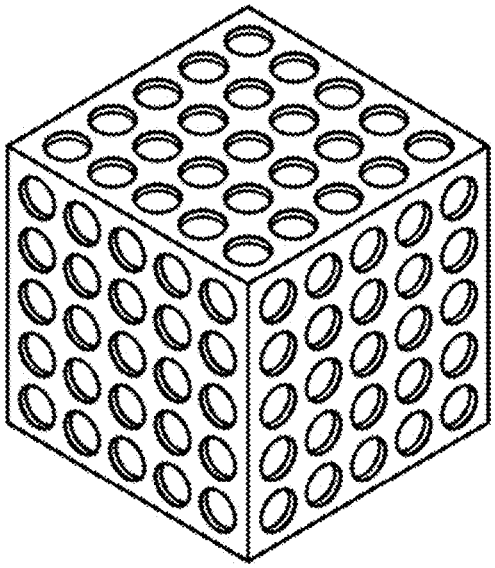

In addition, power delivery module conductor arrays may be formed in three dimensions. For example, as shown in FIG. 40*a*, a linear type power delivery module conductor array may be formed in three dimensions to create a cube or other rectangular prism. FIG. 40*b* shows a similar example of a power delivery module conductor array in a cube shape designed to accept "nailhead" or other type projections of functional modules on different sides thereof. Of course, other three-dimensional shapes are possible as well.

Figure 42A:
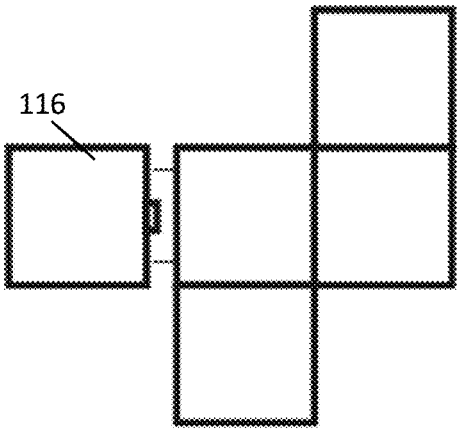
FIGS. 42*a*, 42*b* and 42*c* are plan views of power delivery module mosaics according to exemplary embodiments.
Figure 42B:
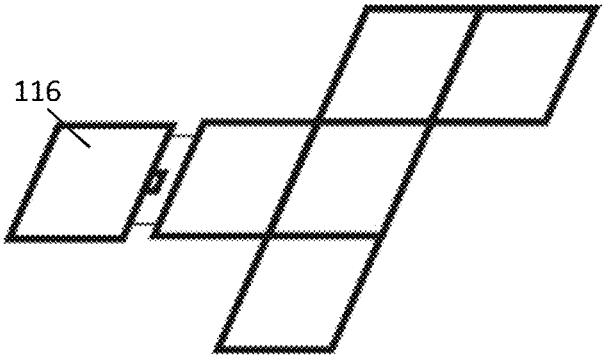
Figure 42C:
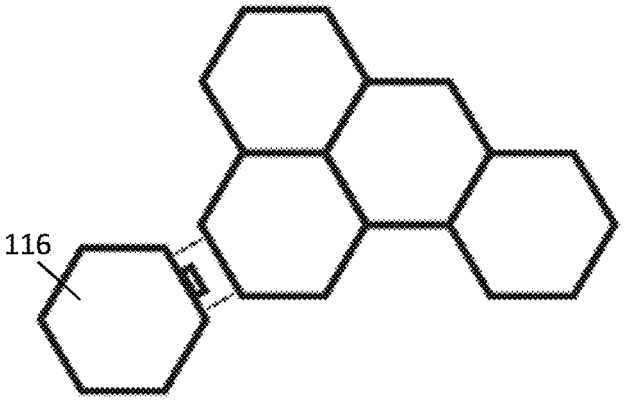

In another example, power delivery conductor arrays may be configured as interconnectable modules. For example, as shown in FIGS. 42*a*, 42*b* and 42*c*, power delivery conductor array modules 116 may be connected to one another to form larger mosaic arrays. While the arrays shown in FIG. 42 are depicted as existing in two dimensions, mosaic arrays of power delivery modules may also be configured in three dimensions. For example, the square modules shown in FIG. 42*a* may be configured to be connected to one another in three dimensions, resulting in a cube type array such as those shown in FIGS. 40*a* and 40*b*, with power delivery modules each forming a side of the cube. Dummy, or non-powered, modules may also be connectable to power delivery modules.

Figure 49:
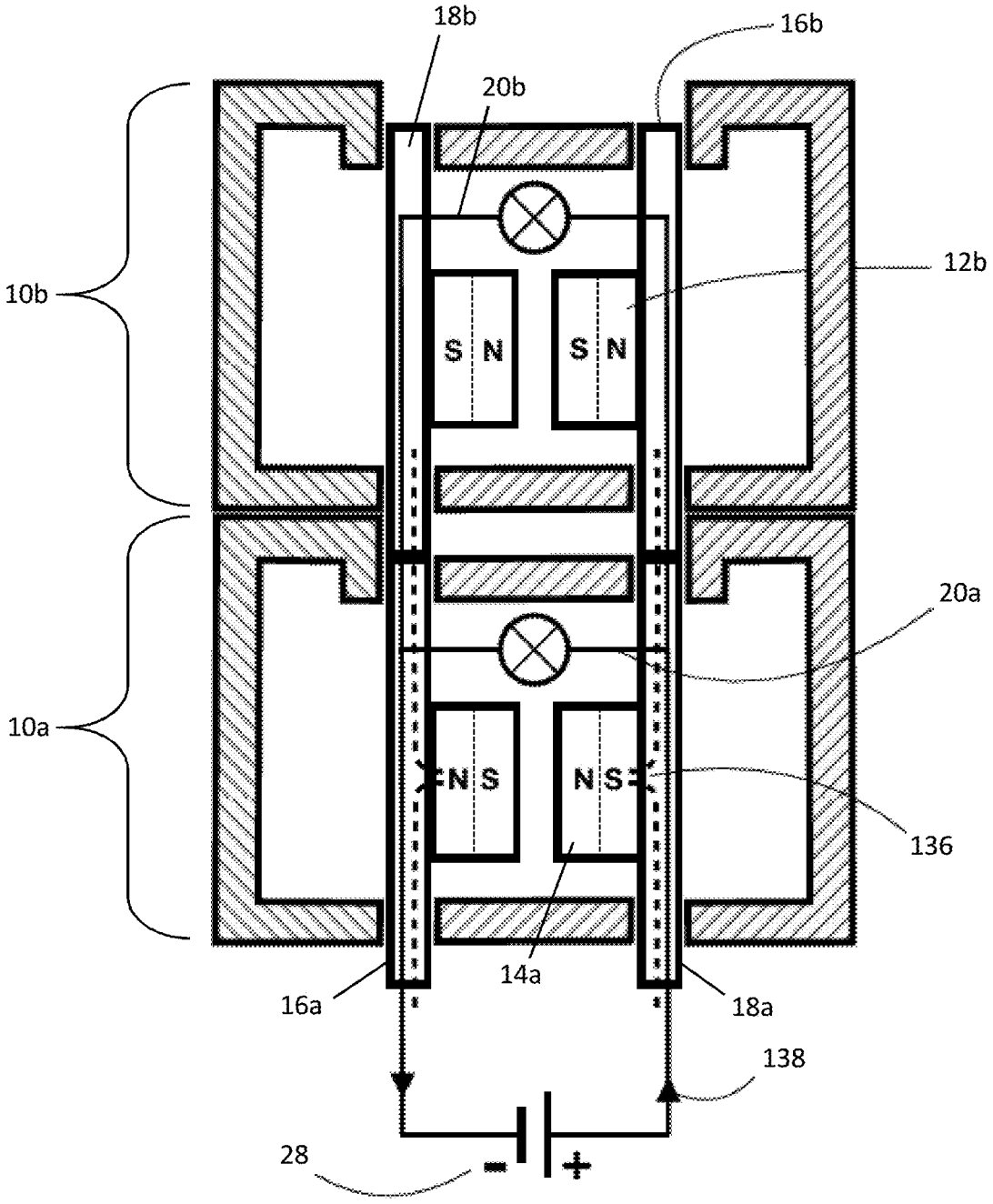
FIG. 49 shows a cross sectional view of interconnected functional modules according to an exemplary embodiment.

In another example, shown in FIG. 49, functional modules 10*a* and 10*b* may be configured as interconnectable modules. In this example, conductors have two exposed portions. As shown, conductors 16*b* and 18*b* of module 10*b* are attracted to and contact conductors 18*a* and 16*a*, respectively, of module 10*a*. Note that polarities of the magnets will dictate orientations in which conductors are attracted to and not repulsed by one another as a result of magnetic flux emanating from the magnets. For example, as shown, the magnetic flux 136 between magnet 14*a* and 12*b* induces attraction of the conductors 18*a* and 16*b* in the configuration shown. It should also be noted that power 138 received from power source 28 may be conducted through the conductors of the functional modules at the same time as magnetic flux. For example, in the configuration shown, power 138 is conducted from the power source 28 by conductors 16*a* and 18*a*, to circuitry 20*a*, and then on to conductors 18*b* and 16*b* of module 10*b* until it is finally received by circuitry 20*b*. Conductors 16*b* and 18*b* are exposed in two places, one being open in the configuration shown for accepting additional functional or power delivery modules.

Figure 50A:
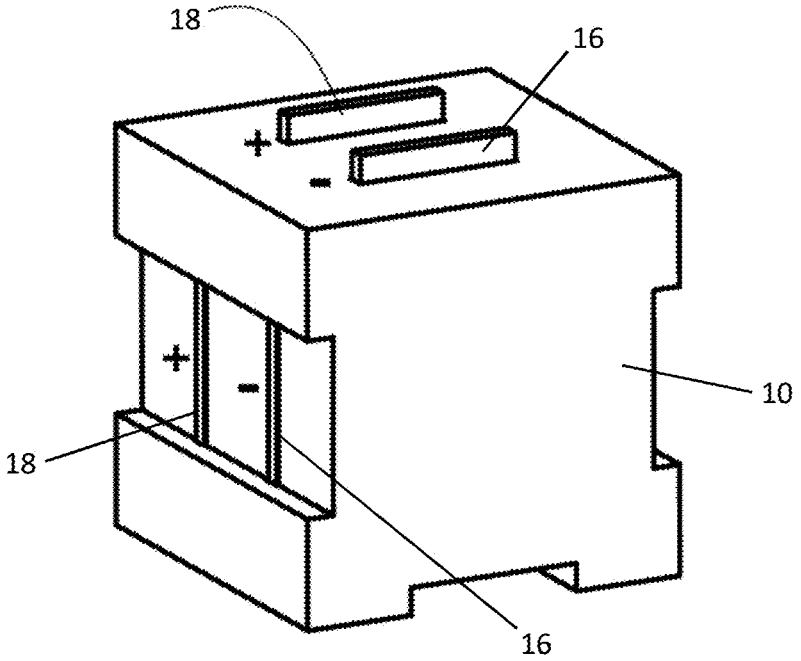
FIG. 50*a* shows a perspective view of an exemplary of a module that is configured with exposed portions of conductors on two perpendicular sides of the module according to an exemplary embodiment.
Figure 50B:
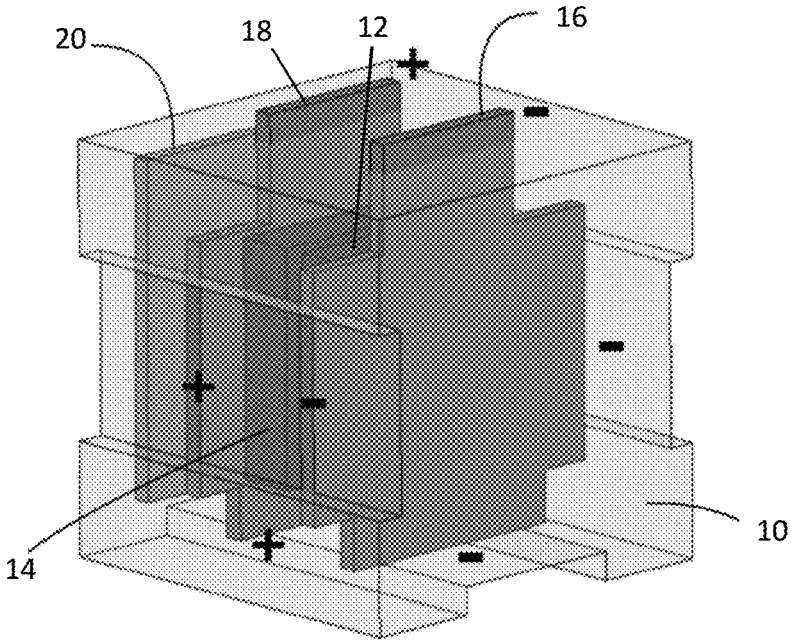
FIG. 50*b* shows a perspective, see-though view of a module in which conductors are exposed on four sides of the module according to an exemplary embodiment.
Figure 50C:
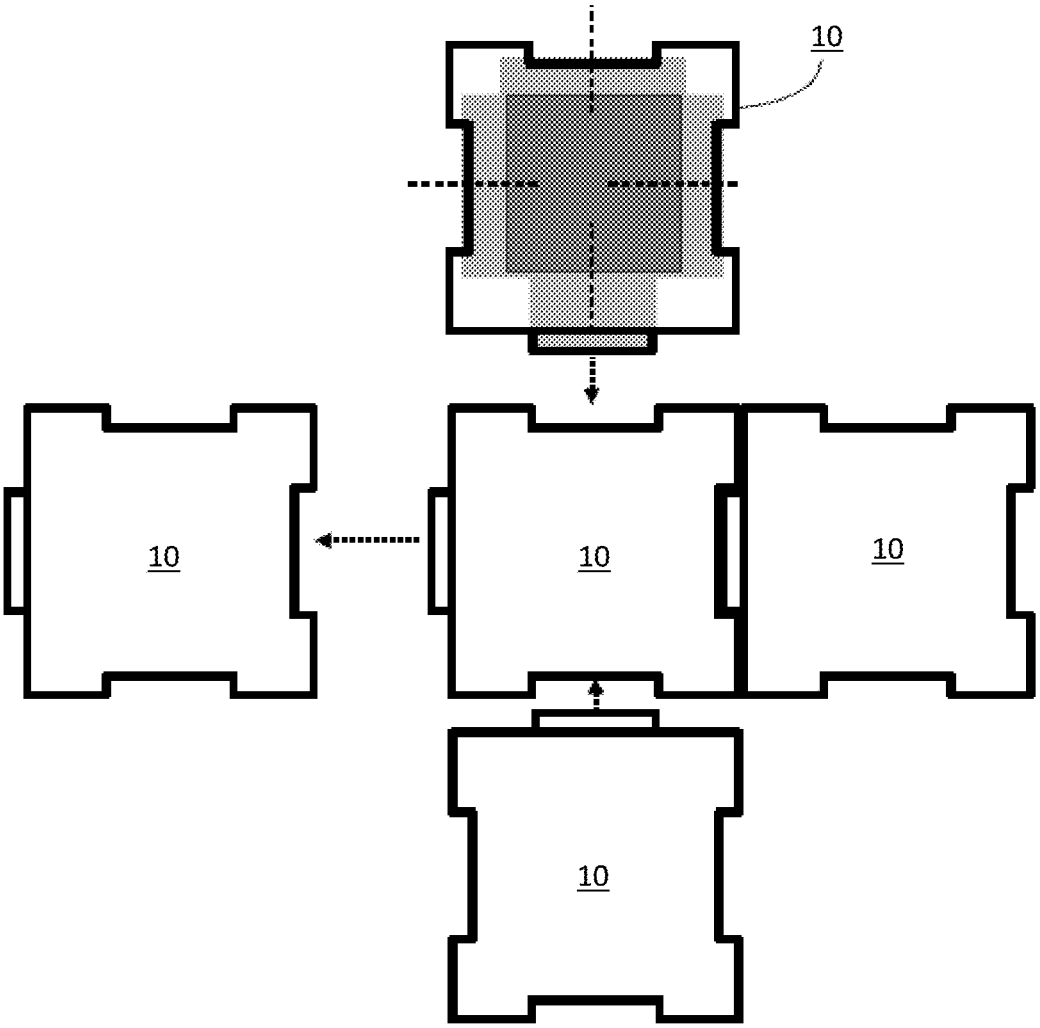
FIG. 50*c* shows a plan view of a mosaic of connected modules according to an exemplary embodiment.

FIG. 50*a* shows a perspective view of similar example of a module 10 that is configured with exposed portions of conductors 16 and 18 on two perpendicular sides of the module. FIG. 50*b* shows a perspective, see-through view of a module 10 in which conductors 16 and 18 are exposed on four sides of the module 10 in order to receive functional or power delivery modules thereon. As shown in FIG. 50*b*, magnets 12 and 16 may be configured to provide magnetic flux to each exposed portion of conductors 16 and 18, respectively. Circuitry 20 may be embedded within the module 10. As shown in FIG. 50*c*, many functional modules 10 may be interconnected to form a mosaic of connected modules. Although shown connected in a two dimensional mosaic in FIG. 50, functional modules may be configured to be connected in three dimensional mosaics as well.

Figure 30A:
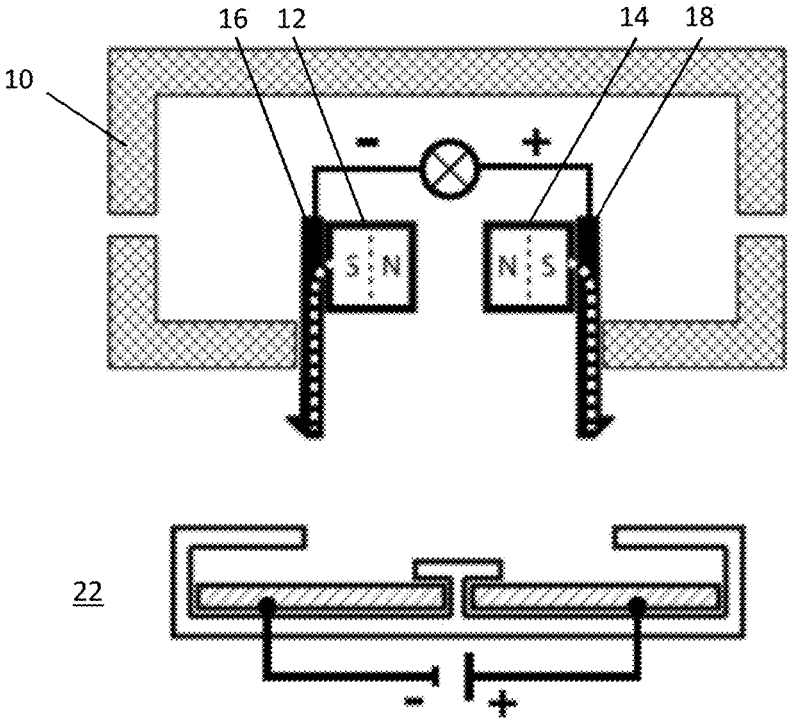
FIGS. 30*a*-30*c* are cross section views of a functional module engaging with a power delivery module according to an exemplary embodiment.
Figure 30B:
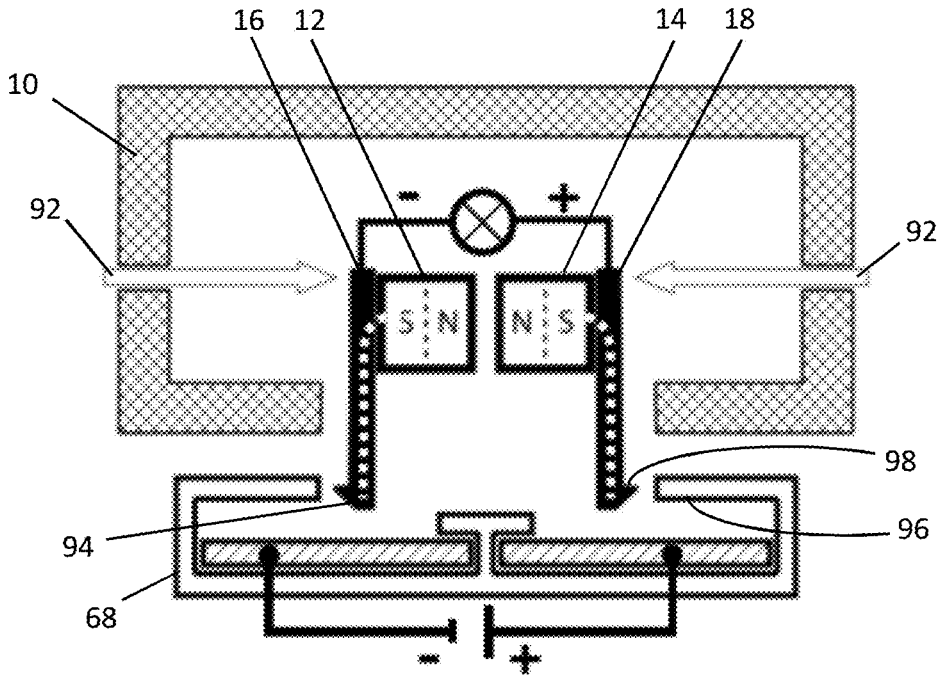
Figure 30C:
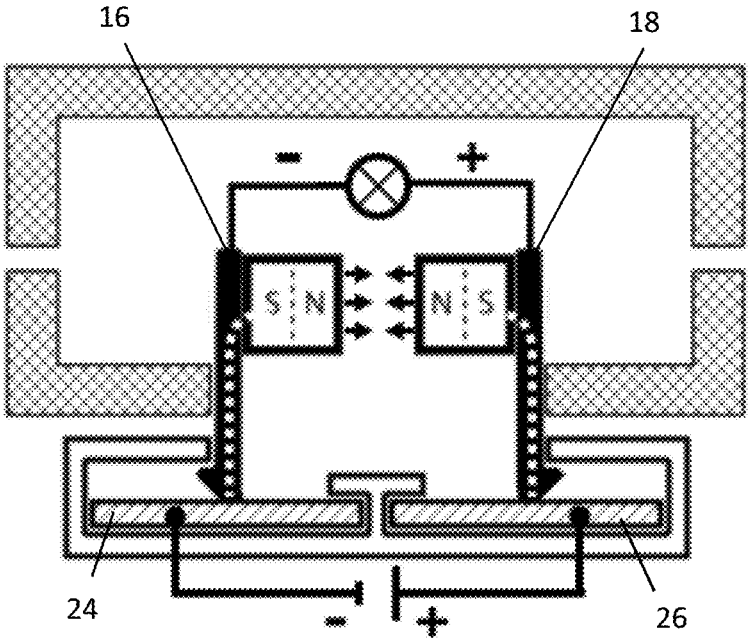

In another aspect, one or more magnets 12, 14 and/or conductors 16, 18 within functional module 10 may be configured to move to provide a mechanical locking of the functional module 10 to a power delivery module 22. In one example, shown in FIGS. 30*a-c* electromagnetic conductor assemblies 12-16 and 14-18 are configured to move in a translational manner towards and away from each other within functional module 10. As shown in FIG. 30*a*, the magnets 12 and 14 are aligned such that like polarities face one another, resulting in a repulsion force between electromagnetic conductor assemblies 12-16 and 14-18. As shown in FIG. 30*b*, a force 92 may be applied to electromagnetic conductor assemblies 12-16 and 14-18 to force them together to permit conductors 16 and 18 to enter insulative web 68. Alternatively, or in addition, a beveled surface 94 of conductors 16 and 18 may bear on an edge of the insulative web 68 to force conductors 16 and 18 inwards to permit entry. As shown in FIG. 30C, once inside insulative web 68, a hook surface 98 of conductors 16 and 18 engages with an underside of the insulative web 96 to mechanically lock the functional module 10 to the power delivery module 22. In this position, conductors 16 and 18 also contact the conductors 24 and 26 of power delivery module 22.

Figure 31A:
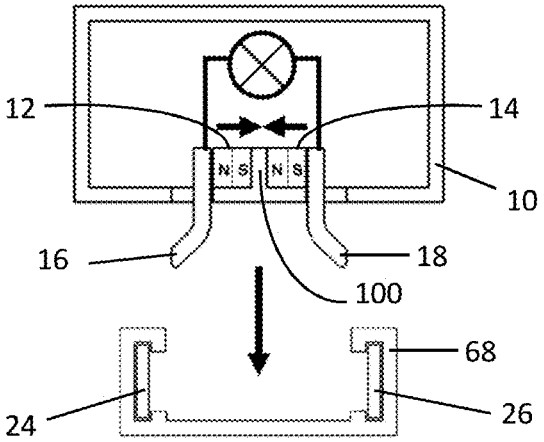
FIGS. 31*a*-31*c* are cross section views of a functional module engaging with a power delivery module according to an exemplary embodiment.
Figure 31B:
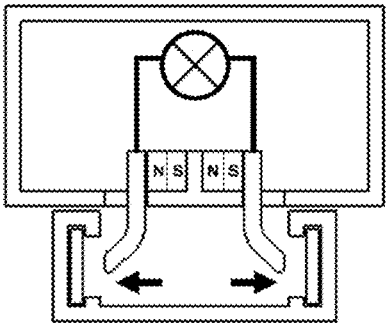
Figure 31C:
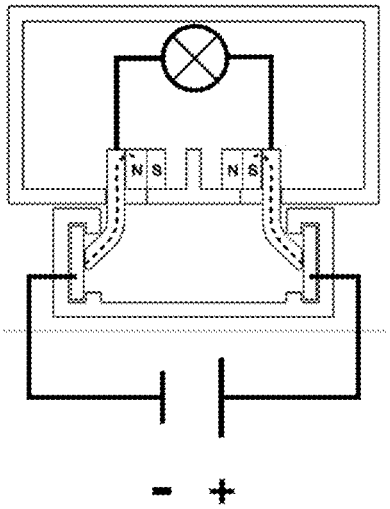

In another example, shown in FIGS. 31*a*-31*c*, power delivery module conductors 24 and 26 may be oriented on opposite sides inside an insulative web 68. Moving electromagnetic conductor assemblies 12-16 and 14-18 of a functional module 10 move together to enter the web 68 and then move apart to connect electrically to conductors 24 and 26 and physically to the insulative web 68. As shown in FIG. 31*a*, the polarity of magnets 12 and 14 may be arranged such that they are attracted to one another to assist with insertion. However, once within insulative web 68, a proximity between conductors 16 and 18 and conductors 24 and 26 may be configured such that the attraction between conductors is greater than the attraction between magnets within the functional module, resulting in conductors contacting one another, forcing magnets apart. A finger 100 within the functional module may prevent the magnets 12 and 14 from coming into contact with one another.

Figure 32A:
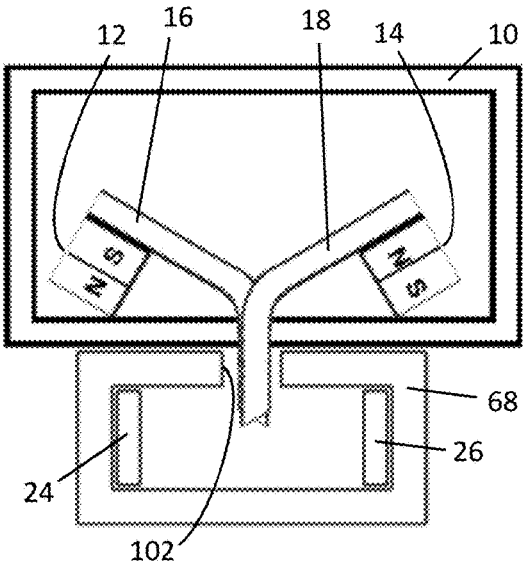
FIGS. 32*a* and 32*b* are cross section views of a functional module engaging with a power delivery module according to an exemplary embodiment.
Figure 32B:
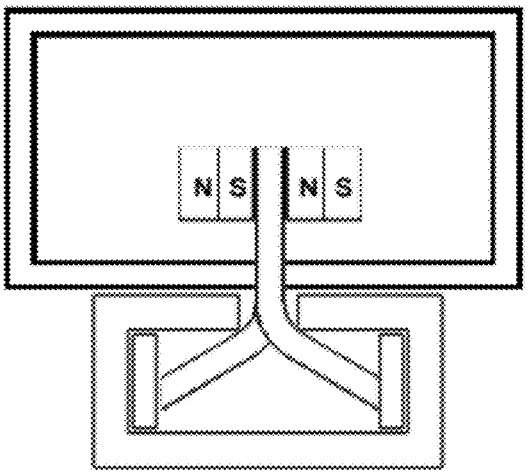
Figure 32C:
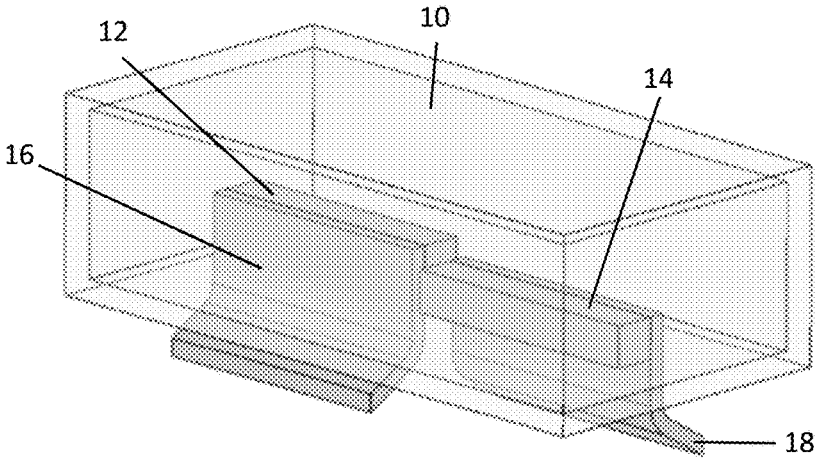
FIG. 32*c* is a perspective view of the functional module shown in FIGS. 32*a* and 32*b*.

In yet another example, electromagnetic conductor assemblies may be configured to rotate within a functional module. For example, as shown in FIG. 32*a*-32*c*, electromagnetic conductor assemblies 12-16 and 14-18 of a functional module 10 may be configured to rotate from an unlocked position shown in FIG. 32*a* in which conductors are generally aligned to a locked position shown in FIG. 32*b* in which conductors 16 and 18 are deployed in a wing-like fashion within insulative web 68. As shown in FIG. 32*c*, electromagnetic conductor assemblies 12-16 and 14-18 may be arrayed beside one another along a direction of a slot 102 of an insulative web 68.

Figure 33A:
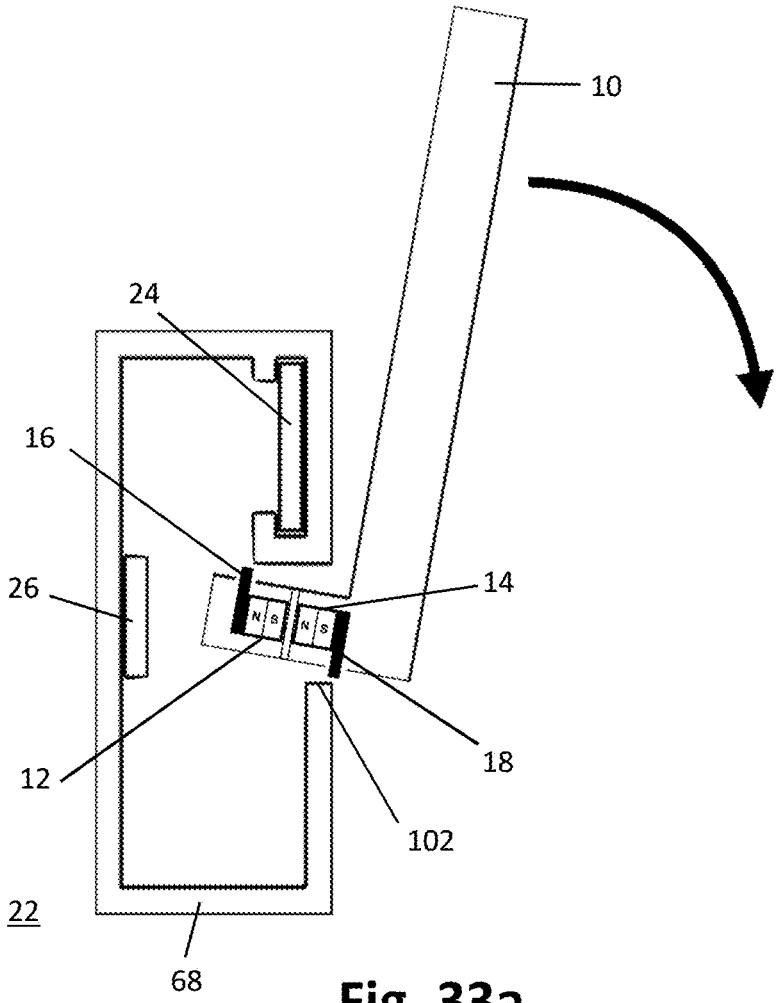
FIGS. 33*a* and 33*b* are cross section views of a functional module engaging with a power delivery module according to an exemplary embodiment.
Figure 33B:
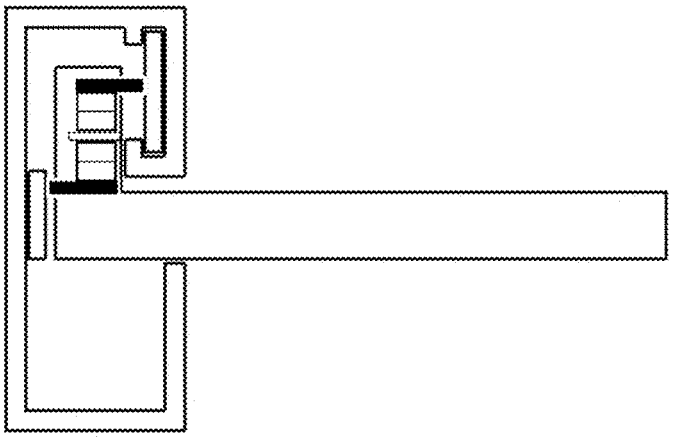

In another example, shown in FIGS. 33*a* and 33*b*, magnets 12 and 14 and conductors 16 and 18 of a functional module 10 may be arranged on a leg of the functional module configured to enter a channel within a power delivery module. Conductors 16 and 18 of the functional module are configured on opposite sides of the leg, with one facing away from a remainder of the functional module (e.g., conductor 16) and one facing towards a remainder of the functional module (e.g., conductor 18). Within the power delivery module 22, one conductor faces an entry slot 102 in an insulative web 68 (e.g., conductor 24) and one faces away (e.g., conductor 26). The leg of the functional module is configured to enter the slot 102 first, then the entire functional module 10 is rotated to place the leg further within the power delivery module until conductor pairs 16-24 and 18-26 contact. At this time, an underside of the functional module may also be configured to contact a side of slot 102. In this arrangement, functional module 10 is provided with substantial strength and rigidity, sufficient to function as a shelf for holding objects thereon.

Figure 34:
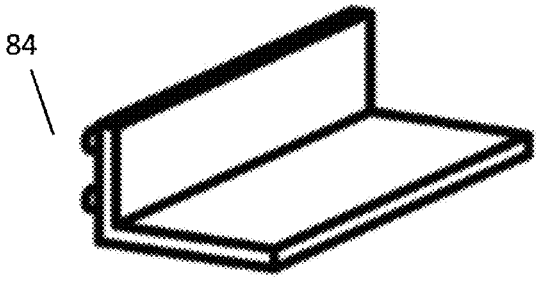
FIG. 34 is a perspective view of a functional module according to an exemplary embodiment.
Figure 35:
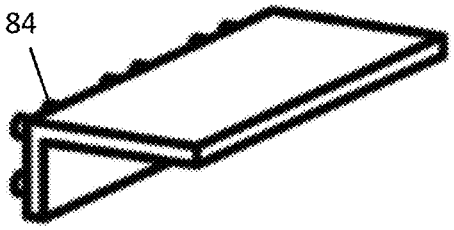
FIG. 35 is a perspective view of a functional module according to an exemplary embodiment.

In another example of a shelf functional module, shown in FIGS. 34 and 35, a shelf includes projections 84 on a leg thereof that are configured to engage with holes 82 in the cover 80 of a power delivery module 22 having locking features, such as is shown in FIGS. 25*a*-*c* and 26*a*-*c*.

Figure 36:
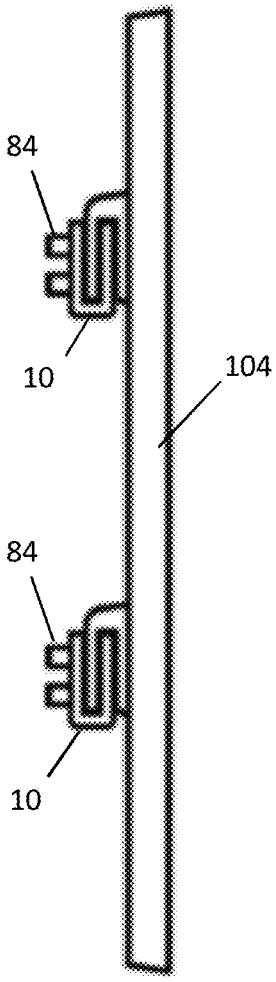
FIG. 36 is a side view of functional modules engaging with an object according to an exemplary embodiment.

In another example, one or more functional modules may be configured as a hook, with an upward projecting front leg, configured to support a mating hook or another object, such as a cell phone or tablet computer. For example, as shown in FIG. 36, a flat panel display or television 104 is supported by two hook functional modules 10, each including locking projections 84 configured to engage with holes 82 in the cover 80 of a power delivery module 22 having locking features, such as is shown in FIGS. 25*a*-*c* and 26*a*-*c*. In a similar example, one or more functional modules may provide a French cleat type connection with beveled mating surfaces.

Figure 37A:
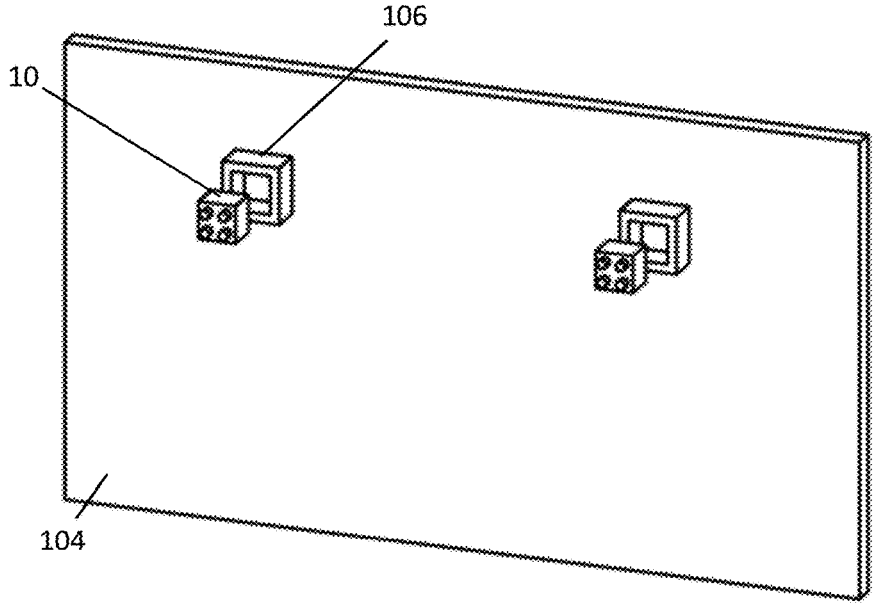
FIG. 37*a* is a perspective view of functional modules engaging with an object according to an exemplary embodiment.
Figure 37B:
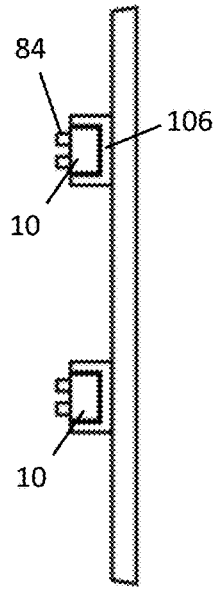
FIG. 37*b* is a side view of the functional modules engaged with an object according to the embodiment shown in FIG. 37*a*.

A similar example is shown in FIGS. 37*a* and 37*b*, in which functional modules 10 include locking projections 84 and are received in receptacles 106 in or attached to an object 104 such as a flat panel display or television.

In any example in which a functional module is configured to support another object, connectivity features may be included in the functional module (including wireless connectivity features) to communicate electrical power or signals from conductors of the power delivery module, through the functional modules(s) to the supported object.

Figure 38:
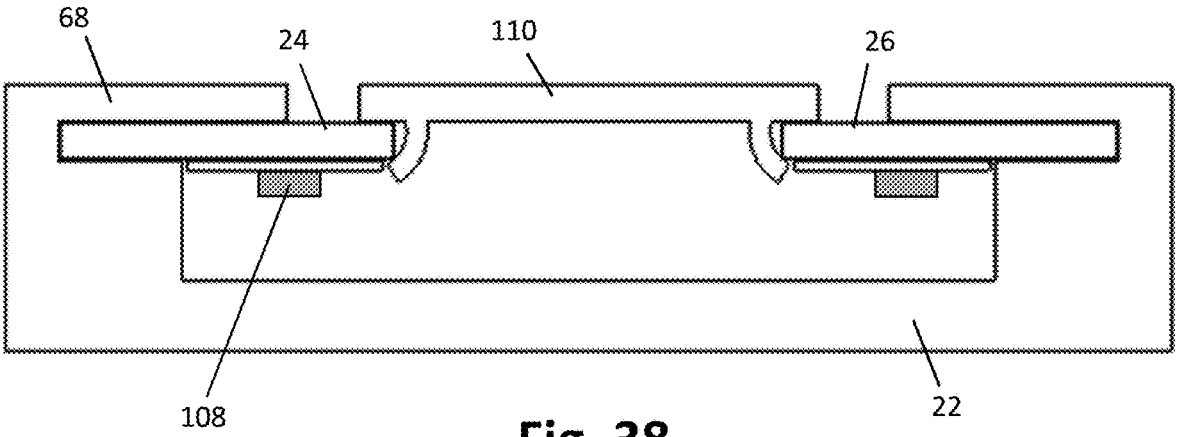
FIG. 38 is a cross section view of a power delivery module according to an exemplary embodiment.

In another aspect, a power delivery module 22 may include a lighting feature. For example, as shown in FIG. 38, a power delivery module may be configured to include conductors 24 and 26 as in other examples as well as lights 108. In one example, lights 108 are led strips with LED elements spaced at intervals along a length of the module. As shown in FIG. 38, the lights may be directed into the module's web 68 and the module may include a transparent or translucent diffuser strip 110 to permit the light to escape the module. In the example shown, the diffuser 110 is attached to conductors 24 and 26 while allowing a portion of conductors 24 and 26 to be accessible to functional modules. In this example, the lights 108 may be bonded to the conductors 24 and 26 in such a way that the conductors serve also serve as heat sinks for the lights.

Figure 45:
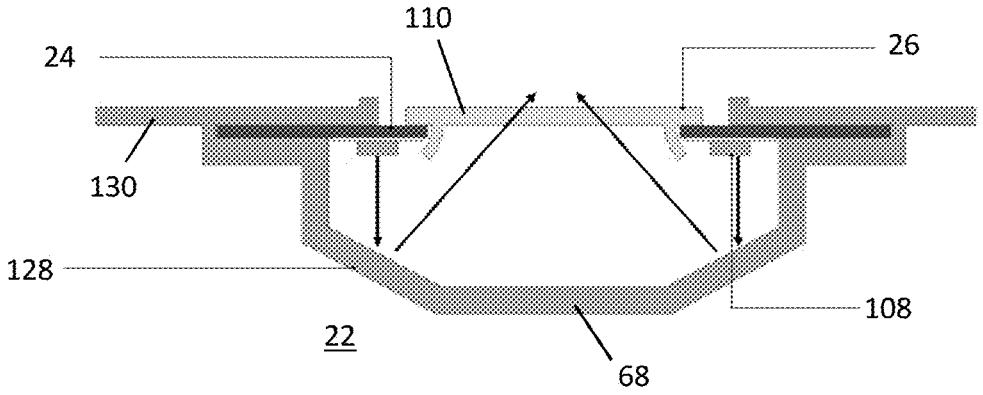
FIGS. 45-47 show cross section views of additional examples of power delivery modules with lighting features according to exemplary embodiments.

Another example of a power delivery module 22 with a lighting feature is shown in FIG. 45. In this example, lights 108 (which may again be LED strips) are directed down towards beveled portions 128 of the module's web 68. The beveled portions 128 redirect light out through a transparent or translucent diffuser strip 110. The module's web 68 may also include flanges 130 for flush mounting the module 22.

Figure 46:
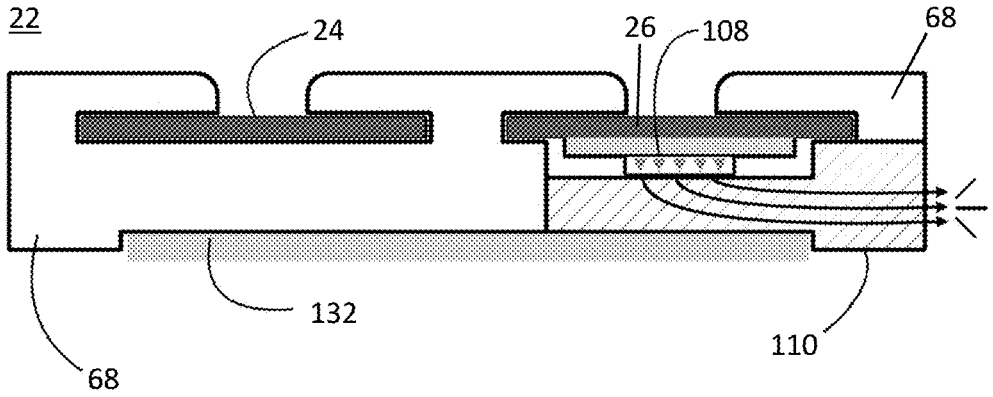

Another example of a power delivery module 22 with a lighting feature is shown in FIG. 46. In this example, a light 108 (which may again be LED strips) is opposite the exposed side of a conductor and its luminance is directed through a transparent or translucent diffuser 110 such that the luminance is redirected from the direction it leaves the light 108. In one example, attaching an LED strip to a conductor allows the heat emitted by the LED's to dissipate through the metal of the conductor, increasing the lifetime of the LED strips. In this configuration, the conductor acts as a heat sink for the LED strip. In the example shown in FIG. 46, the luminance is redirected by approximately 90 degrees so that it exits the module 22 through a side thereof perpendicular to the exposed surface of conductor 26. Any degree of redirection is possible and compatible with this aspect of the disclosure. In addition, although FIG. 46 shows one light 108, more lights may be added, for example to the underside of conductor 24. An adhesive or adhesive tape 132 may be provided for mounting the module 22 to a surface. In the configuration shown in FIG. 46, when mounted to a surface using adhesive 132, the luminance from light 108 would be redirected substantially parallel to that surface. In one example, web 68 may be extruded from a non-conducting material such as plastic and diffuser 110 may be co-extruded therewith or else separately formed or extruded and subsequently bonded or attached thereto.

Figure 47:
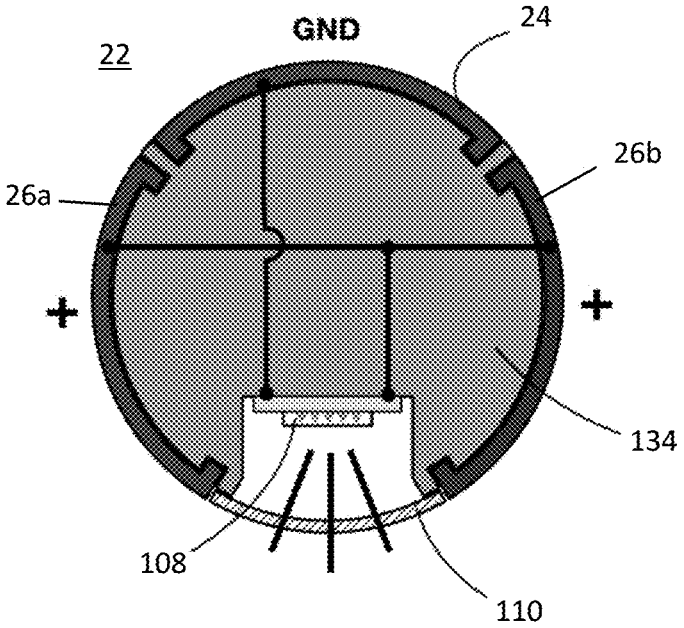

Another example of a power delivery module 22 with a lighting feature is shown in FIG. 47. In this example, the module 22 is formed as an elongate rod with a ground conductor 24 and two electrically interconnected positive conductors 26*a* and 26*b*. A light 108 is included within the module and is directed outward through diffuser 110. The module may include a structural core 134 that may be configured as a solid material that gives rigidity to the module. For example, the structural core 134 may be comprised of a non-conductive extruded material such as plastic or, in another example, of a hardened, initially flowable material such as epoxy.

Figure 48A:
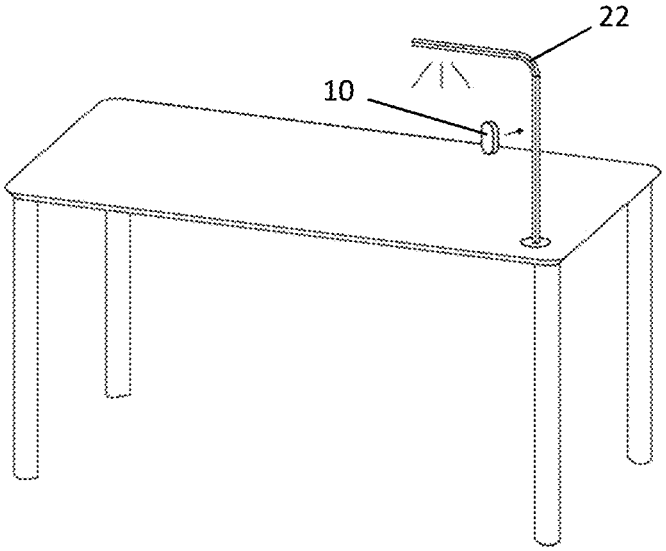
FIGS. 48*a* and 48*b* are perspective views of power delivery modules in rod form that have lighting features according to exemplary embodiments.
Figure 48B:
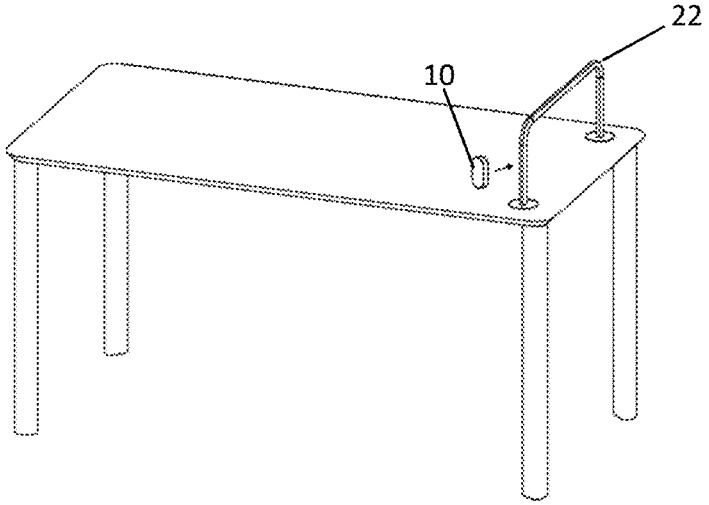
Figure 48C:
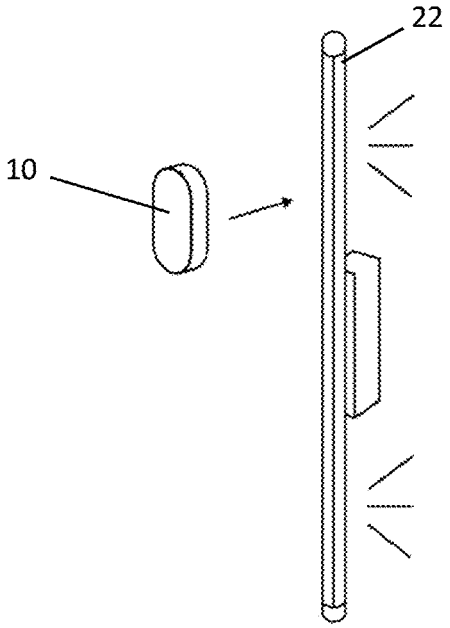
FIG. 48*c* is a perspective view of a power delivery module with a lighting feature that is configured as a surface mount module according to an exemplary embodiment.

FIGS. 48*a* and 48*b* are perspective views of power delivery modules 22 in rod form that have lighting features. As depicted, the power delivery modules are integrated into (or placed on top of) a table and are configured such that luminance from the lighting feature is directed down towards the table surface. FIG. 48*c* is a perspective view of a power delivery module 22 with a lighting feature that is configured as a surface mount module. Luminance from the lighting feature is directed back towards or parallel along the surface to which the module 22 is mounted. In each of the examples shown in FIGS. 48*a*, 48*b* and 48*c*, a functional module 10 is attachable to the power supply module 22 at any point along its length.

Figure 39A:
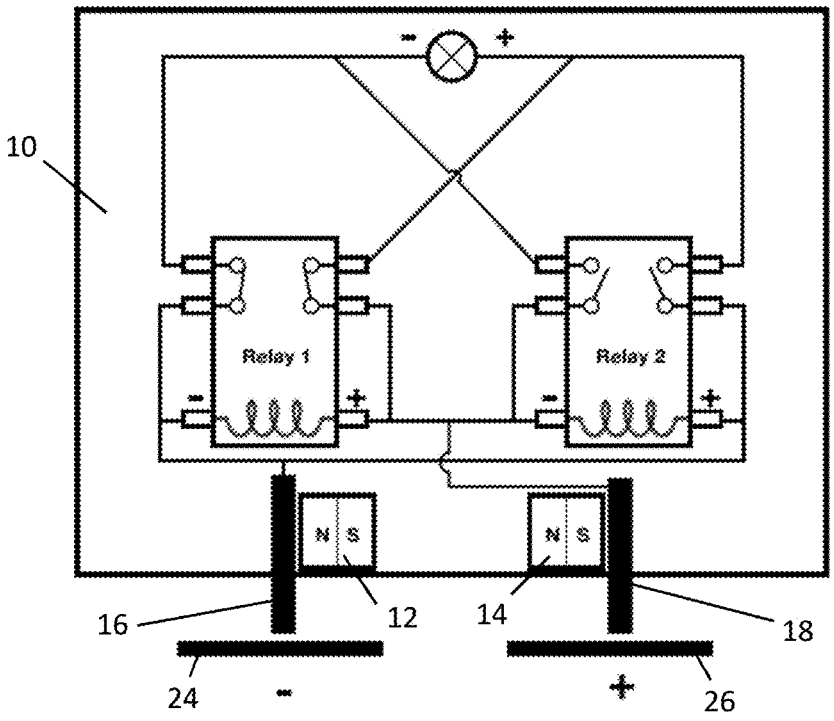
FIGS. 39*a* and 39*b* are schematic cross section views of a power delivery module engaging with a functional module that includes an automatic polarity reversing feature according to an exemplary embodiment.
Figure 39B:
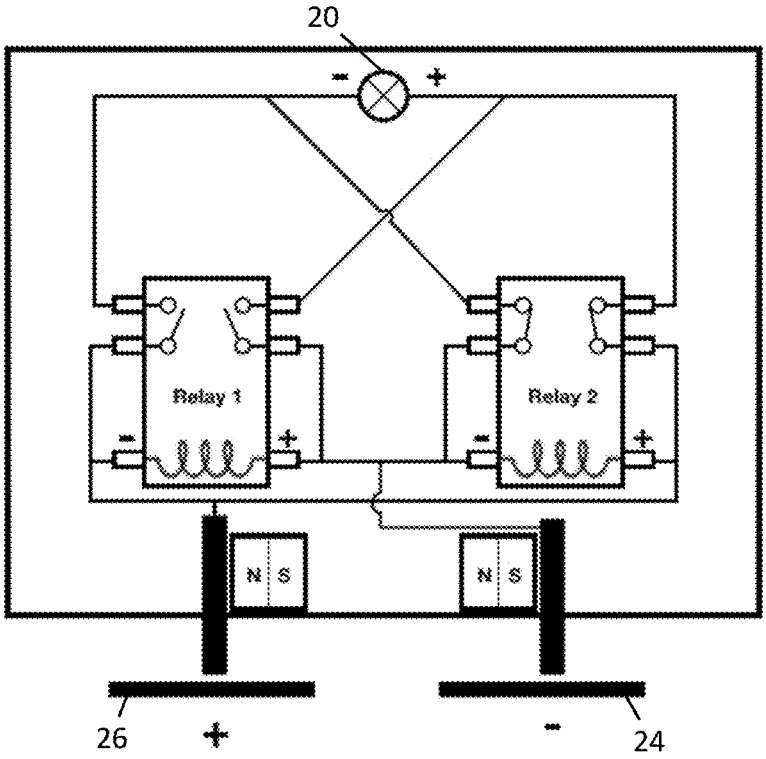

In another aspect, circuitry of functional modules may include an automatic polarity reversing feature to enable aspects of the circuitry to function the same no matter what orientation a functional module engages with a power delivery module. In the example shown in FIGS. 39*a* and 39*b*, no matter the polarity of the conductors 24 and 26 to which the functional module 10 is connected, the circuitry 20 of the functional module 10 receives the same polarity power. In the example shown, Relay 1 and Relay 2 are each normally open, double pole single throw relays with a unidirectional coil. That is, the coil only actuates the relay if power is applied across it with a certain polarity. Such a function may be conferred with an inline diode, for example. The diode may be built into the relays or may be included externally to the relays.

A broad array of functional modules are compatible with the innovations disclosed herein. For example, in addition to the functional modules described above, other functional modules compatible with the innovations described herein include, but are not limited to powered functional modules such as a USB connector (e.g., 112 in FIG. 7), a wired or wireless electronic device charger or dock, a fan, a clock or timer, a visual display, a smart picture frame, an audiovisual accessory, a speaker, a camera, sensors (e.g, temperature, humidity, vibration, infrared, etc.), data capture accessories for Internet of Things (IoT) applications, machine learning accessories, Artificial Intelligence accessories, geofencing accessories, GPS accessories, Augmented Reality (AR) accessories, Virtual Reality (VR) accessories, Mixed Reality (MR) accessories, etc. Functional modules may also be unpowered, for example, writing implement holders (e.g., 114 in FIG. 7), stationary trays, business card holders, flower vases, unpowered storage shelves, hooks, traditional picture frames, interior decorating items such as cloth, curtains, accents, etc., tool holders, mirrors, toothbrush holders, knife racks, spice racks, utensil holder, drawing boards, toys, key holders, etc.

The innovations described herein are applicable in a wide range of settings and applications. For example, applications of the innovations described herein may be realized in homes (including mobile homes and prefabricated homes), offices, hotels and hotel rooms, schools and classrooms, restaurants, hospitals and hospital rooms, factories, airports, transportation (including on vehicles such as automobiles, recreational vehicles, trains, boats, ships, ferries, cruise ships, and airplanes). As another example, the innovations described herein may be applied to furniture such as cabinets, tables, desks, benches, racks, shelves, doors, door or window frames, etc. As a further example, the innovations described herein may be applied as architectural elements, for example in interiors or exteriors as one or more surface mounted, recessed or flush mounted modules.

In order to address various issues and advance the art, the entirety of this application (including the Cover Page, Title, Headings, Background, Summary, Brief Description of the Drawings, Detailed Description, Claims, Abstract, Figures, and otherwise) shows, by way of illustration, various embodiments in which the claimed present subject matters may be practiced. The advantages and features of the application are of a representative sample of embodiments only, and are not exhaustive and/or exclusive. They are presented only to assist in understanding and teach the claimed principles. It should be understood that they are not representative of all claimed present subject matters. As such, certain aspects of the disclosure have not been discussed herein. That alternative embodiments may not have been presented for a specific portion of the present subject matter or that further undescribed alternate embodiments may be available for a portion is not to be considered a disclaimer of those alternate embodiments. It may be appreciated that many of those undescribed embodiments incorporate the same principles of the present subject matters and others are equivalent. Thus, it is to be understood that other embodiments may be utilized and functional, logical, operational, organizational, structural and/or topological modifications may be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. Also, some of these embodiments and features thereof may be mutually contradictory, in that they cannot be simultaneously present in a single embodiment. Similarly, some features are applicable to one aspect of the present subject matter, and inapplicable to others. In addition, the disclosure includes other present subject matters not presently claimed. Applicant reserves all rights in those presently unclaimed present subject matters including the right to claim such present subject matters, file additional applications, continuations, continuations in part, divisions, and/or the like thereof. As such, it should be understood that advantages, embodiments, examples, functional, features, logical, operational, organizational, structural, topological, and/or other aspects of the disclosure are not to be considered limitations on the disclosure as defined by the claims or limitations on equivalents to the claims. It is to be understood that, depending on the particular needs and/or characteristics of modular electromagnetic connection user, various embodiments of the modules employing such connections be implemented that enable a great deal of flexibility and customization.

What is claimed is:

1. A functional module comprising:

a magnet;

a conductor wraps around at least part of a periphery of the magnet;

a peg situated in and movable through an aperture of the magnet;

a biasing member configured to resist a movement of the peg through the magnet aperture into the functional module; and circuitry electrically connected to the conductor and the peg, wherein at least one of the conductor and the peg is formed of a ferrous material and is configured to channel and focus magnetic flux from the magnet, thereby increasing a strength of magnetic flux at an exterior surface of the at least one of the conductor and the peg to a level greater than would be present there with the magnet alone, while at the same time the conductor and the peg are configured to electrically conduct at least one of power and data to the circuitry.

2. The functional module of claim 1, wherein the magnet is a toroidal magnet and the conductor circumscribes and contacts an exterior surface of the magnet.

3. The functional module of claim 1, further comprising an electrically insulative material between a surface of the magnet aperture and the peg.

4. The functional module of claim 1, further comprising an electrically insulative material between an exterior surface of the magnet and the conductor.

5. The functional module of claim 1, wherein the conductor protrudes from an exterior surface of a housing of the functional module.

6. The functional module of claim 1, wherein the biasing member is configured to provide at least a portion of an electrically conductive path between the peg and the circuitry.

7. A modular system, comprising:

a functional module comprising:

a magnet;

a conductor formed around the magnet, a peg situated in and movable through an aperture of the magnet, a biasing member configured to resist a movement of the peg through the magnet aperture into the functional module, and circuitry electrically connected to the conductor and the peg, wherein at least one of the conductor and the peg is formed of a ferrous material and is configured to channel and focus magnetic flux from the magnet, thereby increasing a strength of magnetic flux at an exterior surface of the at least one of the conductor and the peg to a level greater than would be present there with the magnet alone, while at the same time the conductor and the peg are configured to electrically conduct at least one of power and data to the circuitry; and a power delivery module comprising first and second spaced apart power delivery conductors, at least one of which is formed of ferrous material, and a first power supply electrically connected to the first and second conductors, wherein the peg of the functional module is configured to extend from an external surface of the conductor of the functional module by a distance that is greater than the space between the first and second power delivery conductors such that the peg is configured to contact the first power delivery conductor before the conductor of the functional module is able to contact the second power delivery conductor and contact between the conductor of the functional module and the second power delivery conductor occurs after the peg is moved into the functional module against the resistance of the biasing member.

8. The modular system of claim 7, wherein the magnet of the functional module provides an attraction between the functional module and the power delivery module that assists movement of the peg into the functional module against the resistance of the biasing member.

9. The modular system of claim 7, wherein one of the first and second power delivery conductors is formed of non-ferrous electrically conductive material.

10. The modular system of claim 7, wherein the power delivery module further comprises an insulative material between the first and second power delivery conductor configured such that a movement of the functional module in a direction orthogonal to an axis of the peg relative to the power delivery module cannot result in electrical contact between the second power delivery conductor and the peg.

11. The modular system of claim 7, wherein the power delivery module is configured to provide discrete receiving sites for the peg of the functional module, the first power delivery conductor being exposed for contact by the peg only at said discrete receiving sites.

12. The modular system of claim 11, further comprising an insulative material on an exterior of the second power delivery conductor, said insulating material having discrete openings therein around said discrete receiving sites exposing the exterior of the second power delivery conductor for contact by the conductor of the functional module at said discrete receiving sites.

13. The modular system of claim 7, wherein the power delivery module includes an undercut surface configured to physically retain the peg of the functional module in contact with the first power delivery conductor.

14. The modular system of claim 13, wherein the undercut surface of the power delivery module is configured to physically retain the peg of the function module in contact with the first power delivery conductor only after the functional module is shifted in a direction orthogonal to an axis of the peg relative to the power delivery module after the peg contacts the first power delivery conductor.

15. The modular system of claim 7, wherein the power delivery module is configured to provide for connection between the peg and conductor of the functional module and the first and second power delivery conductor, respectively, at non-discrete locations along a length of the power delivery module.

16. The modular system of claim 15, wherein the power delivery module further comprises an additional power delivery conductor electrically connected to the second power delivery conductor and configured such that the conductor of the functional module contacts the additional power delivery conductor as the conductor of the functional module also contacts the second power delivery conductor.

17. The modular system of claim 15, wherein the power delivery module further comprises third and fourth spaced apart power delivery conductors, at least one of which is formed of ferrous material, the third and fourth power delivery conductors are spaced apart by a smaller distance than the distance that the peg of the functional module extends from the external surface of the conductor of the functional module such that the peg is configured to contact the third power delivery conductor before the conductor of the functional module is able to contact the fourth power delivery conductor and contact between the conductor of the functional module and the fourth power delivery conductor occurs after the peg is moved into the functional module against the resistance of the biasing member.

18. The modular system of claim 17, wherein the third and fourth power delivery conductors are is electrically connected to the first and second power delivery conductors, respectively.

19. The modular system of claim 17, wherein the third and fourth power delivery conductors are electrically connected to a second power supply that is different than the first power supply.

20. The modular system of claim 17, wherein the power delivery module is configured to provide for connection between the peg and conductor of the functional module and the third and fourth power delivery conductor, respectively, at non-discrete locations along a length of the power delivery module.

* * * * *